US005477690A

United States Patent [19]

Gram

[11] Patent Number: 5,477,690

[45] Date of Patent: Dec. 26, 1995

[54] LIQUID CRYOGENIC STORAGE TANK SYSTEM

[75] Inventor: Anker Gram, Vancouver, Canada

[73] Assignee: Process Systems International, Inc., Westborough, Mass.

[21] Appl. No.: 294,084

[22] Filed: Aug. 22, 1994

Related U.S. Application Data

[62] Division of Ser. No. 39,908, Mar. 30, 1993, Pat. No. 5,411,374.

[51] Int. Cl.[6] ..... F17C 5/02

[52] U.S. Cl. ..... 62/45.1; 62/47.1; 62/50.1; 62/50.7

[58] Field of Search ..... 62/7, 47.1, 50.1, 62/50.7, 53.2, 50.6, 45.1

[56] References Cited

U.S. PATENT DOCUMENTS

| | | | |
|---|---|---|---|
| 2,763,397 | 9/1956 | Rice . | |
| 2,944,701 | 7/1960 | Hatanaka | 220/86.1 |
| 3,048,984 | 8/1962 | Ells et al. | 62/49.1 |
| 3,049,887 | 8/1962 | Sharp et al. | 62/49.2 |
| 3,159,004 | 12/1964 | Keith | 62/53.2 |
| 3,181,473 | 5/1965 | Duron . | |
| 3,234,746 | 2/1966 | Cope | 62/50.6 |
| 3,456,585 | 7/1969 | Gottzmann et al. . | |
| 3,602,003 | 8/1971 | Hampton | 62/50.4 |
| 3,630,639 | 12/1971 | Duron et al. . | |
| 3,633,372 | 1/1972 | Kimmel et al. | 62/49.2 |
| 3,812,888 | 5/1974 | Dalton | 62/49.2 X |
| 3,858,404 | 1/1975 | Davis | 62/49.2 |
| 3,967,465 | 7/1976 | Asselman et al. | 62/48.1 |
| 4,259,846 | 4/1981 | Rudolphi et al. | 62/48.1 |
| 4,406,129 | 9/1983 | Mills | 62/7 |
| 4,680,937 | 7/1987 | Young | 62/47.1 |
| 4,689,064 | 8/1987 | Boulanger et al. | 62/47.1 |
| 4,718,239 | 1/1988 | Nowobilski et al. | 62/50.7 X |
| 5,010,868 | 4/1991 | Clements | 123/527 |
| 5,081,977 | 1/1992 | Swenson | 123/527 |
| 5,110,267 | 5/1992 | Giordani | 417/404 |
| 5,127,230 | 7/1992 | Neeser et al. | 62/50.1 X |
| 5,163,409 | 11/1992 | Gustafson et al. | 62/50.2 X |
| 5,165,246 | 11/1992 | Cipolla et al. | 62/47.1 |

FOREIGN PATENT DOCUMENTS 0473555 7/1991 European Pat. Off. .

OTHER PUBLICATIONS

Beale, Jeffrey P., "LNG Fueling Station Overview", Houston, Tex., Jan. 25–27, 1993.

*Primary Examiner*—Christopher Kilner
*Attorney, Agent, or Firm*—Richard P. Crowley

[57] ABSTRACT

Cryogenic fluid piston pump functions as stationary dispensing pump, mobile vehicle fuel pump etc., and can pump vapour and liquid efficiently even at negative feed pressures, thus permitting pump location outside a liquid container. Piston inducts fluid by removing vapour from liquid in an inlet conduit faster than the liquid therein can vaporize by absorbing heat, and moves at essentially constant velocity throughout an induction stroke to generate an essentially steady state induction flow with negligible restriction of flow through an inlet port. Stroke displacement volume is at least two orders of magnitude greater than residual or dead volume remaining in cylinder during stroke changeover, and is greater than volume of inlet conduit. Cryogenic tank has a liquid compartment, a vapour compartment, and inlet and overflow conduits. Inlet conduit receives liquid from dispensing pump and widely disperses liquid into liquid tank to contact and condense vapour. Overflow conduit restricts flow of excess liquid from liquid compartment to vapour compartment. Excess pressure in tank or temperature of overflow liquid from conduit is detected to automatically stop dispensing pump. As a fuel pump, the pump selectively receives cryogenic liquid and vapour from respective conduits communicating with tank, and pumps cryogenic liquid to satisfy relatively heavy fuel demand of engine, which, when satisfied, also pumps vapour to reduce vapour pressure in the tank while sometimes satisfying relatively lighter fuel demand.

17 Claims, 8 Drawing Sheets

LIQUID CRYOGENIC STORAGE TANK SYSTEM

This is a divisional of application Ser. No. 08/039,908, filed on Mar. 30, 1993, now U.S. Pat. No. 5,411,374.

BACKGROUND OF THE INVENTION

The invention relates to a cryogenic pump for pumping cryogenic fluids, such as liquified oxygen etc., but particularly cryogenic hydrocarbons used in hydrocarbon fuel dispensing operations.

Compressed and liquified hydrocarbon gases, typically natural gas which is mostly methane ($CH_4$), have been used for powering vehicles for some time. Compressed natural gas (CNG) is commonly stored at ambient temperatures at pressures of between 2,400 and 3,000 PSI(16,637 and 20,771 kPa), and is unsuitable for trucks and buses due to the limited operating range and heavy weight of the CNG storage tanks.

On the other hand, liquified natural gas (LNG) is normally stored at temperatures of between about −240° F. and −200° F., (about −150° C. and −130° C.) and at pressures of between about 15 and 100 PSIG (204 and 790 kPa) in a cryogenic tank, providing a power density of about four times that of CNG. While LNG has a greater potential for use with buses and trucks than CNG due to this higher power density, problems still exist with both the pumps used at the fuelling stations, and vehicle tanks mounted within the vehicles. For example, at prior art fuelling stations, venting of LNG during the fuelling process in the order of 10% of total fuel delivered is common, and this loss can be attributed to problems associated with the fuel dispensing pump and pressure differential between the storage tank and the vehicle tank. In addition, due to difficulties in determining accurately the actual amount of fuel in the vehicle tank during filling, vehicle tanks are either unintentionally overfilled, risking tank rupture or compounding venting losses, or alternatively, due to the desire of the fuelling operator to reduce venting losses, vehicle tanks are unintentionally only partially filled, and consequently vehicles often exhaust their fuel supply within a short period of having been refuelled.

With respect to the delivery pumps used at fuelling stations, most prior art pumps have a relatively low pump delivery pressure which presents problems as follows. In order to reduce fuelling time to a few minutes, minimum fuelling rates of 25 gallons (100 liters) per minute are desirable, which requires a relatively high pressure drop in the order of 30 to 60 PSIG (310 to 516 kPa) between the pump discharge and the vehicle tank. To sustain flow, the vehicle tank must be vented during the fuelling operation with substantial venting losses. In addition, at the start of each fuelling operation, the valves and relatively large fuelling hoses etc. must be cooled which further increases venting losses. Venting of gases from the vehicle tank requires that the fuelling hose contains both a filling line and a venting line, or two separate hoses are required. Because these hoses contain cold fluid they must be insulated, and the disconnect nozzles are extremely bulky and awkward to handle.

To the inventor's knowledge, prior art cryogenic pumps used for this type of service are centrifugal pumps, which are placed either in the liquid inside the storage tank, or below the storage tank in a separate chamber with a large suction line leading from the tank, with both the pump and suction line being well insulated. Because a cryogenic liquid is always at its boiling temperature when stored, any heat leaked into the suction line and any reduction in pressure will cause vapour to be formed. Thus, if the centrifugal pump is placed outside the tank, vapour is formed and the vapour will cause the pump to cavitate and the flow to stop. Consequently, all prior art cryogenic pumps known to the present inventor require a positive feed pressure to prevent or reduce any tendency to cavitation of the pump. The positive feed pressure is attained by locating the pump several feet, e.g. 5–10 feet (about 2–3 meters) below the lowest level of the liquid within the tank, and such installations are usually very costly. Also, centrifugal pumps cannot easily generate high discharge pressures which are considered necessary to reduce fuelling time.

Reciprocating piston pumps have been used for pumping LNG when high discharge pressures are required, but such pumps also require a positive feed pressure to reduce efficiency losses that can arise with a relatively high speed piston pump. Prior art LNG piston pumps are crankshaft driven at between 200 and 500 RPM with relatively small displacements of approximately 10 cubic inches (164 cu. cms). Such pumps are commonly used for developing high pressures required for filling CNG cylinders and usually have a relatively low delivery capacity of up to about 5 gallons per minute (20 liters per minute). Such pumps are single acting, i.e. they have a single chamber in which an induction stroke is followed by a discharge stroke, and thus the inlet flow will be stopped half of the time while the piston executes the discharge stroke. Furthermore, as the piston is driven by a crank shaft which produces quasi-simple harmonic motion, the piston has a velocity which changes constantly throughout its stroke, with 70% of the displacement of the piston taking place during the time of one-half of the cycle, i.e. one-half of the stroke, and 30% of the piston displacement occurring in the remaining half cycle time. The variations in speed of the piston are repeated 200–500 times per minute, and generate corresponding pressure pulses in the inlet conduit, which cause the liquid to vaporize and condense rapidly. This results in zero inlet flow unless gravity or an inlet pressure above boiling pressure of the liquid forces the liquid into the pump. In addition, the relatively small displacement of these pumps results in relatively small inlet valves which, when opened, tend to unduly restrict flow through the valves. Thus, such pumps require a positive inlet or feed pressure of about 5 to 10 PSIG (135–170 kPa) at the feed or inlet of the reciprocating pump unless the inlet valve is submerged in the cryogenic liquid in which case the feed pressure can be reduced. Large cryogenic piston pumps, with a capacity of about 40 gallons per minute (150 liters per minute) have been built, but such pumps are designed for very high pressure delivery, require a positive feed pressure, and are extremely costly.

With respect to the vehicle tanks, all prior art cryogenic tanks known to the inventor can only be filled partly due to the requirement for an ullage or vapour space above the liquid, which space is dependent on pressure setting of a relief valve. A cryogenic tank is full when liquid within the tank occupies full tank volume at a temperature which has a corresponding boiling pressure equal to the pressure setting of the relief valve. Thus, the colder the liquid, the less volume it occupies and the greater the vapour space above the liquid. As the liquid temperature rises, the vapour space becomes smaller and eventually disappears as the liquid temperature approaches the boiling temperature corresponding to the relief valve pressure setting. Typically, the ullage space is between 10% and 13% of the full tank volume based on conventional relief valve settings. To determine volume of fuel in a tank when filling, normal practice is to provide a dip-tube on the vent or vapour line with the tube terminating at a central location of the tank, and at an elevation which, if the tank was horizontal and the liquid was steady, would provide the required ullage space. When a tank is being filled with high velocity liquid, the liquid in the tank is highly agitated, and thus there is no constant liquid level for measuring liquid volume within the tank. Normal practice is to open the vent line during filling and to watch the vented gas until liquid becomes visible, at which time the filling is stopped. However, liquid can also become visible at the start of the filling operation when the tank is warm and boiling of liquid within the tank creates a heavy mist of vapour space. To ensure the tank is as full as possible, the operator normally waits until an essentially complete liquid stream of LNG appears in the vent tube before stopping the flow, which results in some of the ullage space being filled with cryogenic liquid. When the liquid in the tank expands due to heat leak, pressure in the tank can rise rapidly and excessively, increasing the risk of rupture of the tank.

To reduce heat leak in a small cryogenic tank, commonly a single conduit is used both for liquid delivery into the tank, and liquid drainage or removal from the tank. This is a compromise solution which results in the tank being filled from the bottom of the tank, with little contact between cold liquid being pumped into the tank, and warm vapour above the liquid surface. On the other hand, in large stationary storage tanks, it is common to spray incoming liquid from an upper portion of the tank to increase contact between warm vapour and the incoming liquid which causes a fast reduction in pressure in the tank due to condensing of vapour. While this approach is used with large storage tanks, to the inventor's knowledge, it is not used with the smaller vehicle tanks. The liquid outlet conduit is considered to be hazardous with vehicle tanks, because if there is a breakage in an external line extending from the liquid outlet conduit, essentially all of the liquid in the tank is forced out through the break due to vapour pressure above the liquid. Only when essentially all liquid in the tank has been discharged will excess pressure in the tank be reduced. This hazard is of particular concern for small vehicle tanks in which the external line could be exposed to damage in a motor vehicle accident.

Natural gas burning engines can be classified into two broad classes, namely those having a low pressure fuel system and those having a high pressure fuel system. A low pressure fuel system is defined as a fuel system of an engine which operates on a fuel pressure which is lower than the minimum operating pressure of the tank. In this type of low pressure system, no fuel pump is required and the tank has a vapour conduit which removes vapour from the tank, and a liquid conduit which removes liquid from the tank. Each conduit is controlled by a respective valve, which in turn is controlled by at least one pressure sensor. The engine normally receives fuel through the liquid conduit, except in instances where tank pressure exceeds a maximum, in which case the vapour conduit is opened, so as to release some vapour to the engine, which reduces pressure in the tank, thus enabling continued operation on liquid from the tank. This is a simple system which ensures that tank pressure is kept low by taking fuel in the vapour phase from the tank whenever pressure in the tank is over a minimum level, for example about 60 PSIG (516 kPa).

In contrast, a high pressure fuel system requires a fuel pump which supplies fuel at a pressure of between 300 and 3,000 PSIG (2,168 and 20,771 kPa), depending on fuel system parameters. This is usually accomplished by a small displacement piston pump located inside the vehicle tank with a submerged inlet to ensure a positive feed pressure. Such installation is difficult to install and service, and makes the fuel tank and pump assembly relatively large. Because the pump can only pump liquid, all vapour generated by heat leak and working of the pump will decrease the holding time of the tank by a substantial amount, and result in high fuel loss because the vapour must be vented prior to refuelling the tank. This venting of vapour reduces effective capacity of the vehicle tanks still further, compounding the difficulty of use of LNG in a vehicle tank. To the inventor's knowledge, there is no single pump which can efficiently pump both liquid and vapour, or a mixture of both, and thus a system which can remove and burn vapour in the engine is not available for high pressure fuel systems. Also, conventional piston pumps require a positive pressure at the inlet port, which severely limits location of such pumps, and in particular such pumps cannot be used with a vehicle tank having a conventional "over the top" liquid outlet. Many problems would be solved if a vehicle fuel pump could be developed which could operate with a negative suction pressure which would permit the vehicle pump to be located outside the vehicle tank and placed wherever space is available in the vehicle.

SUMMARY OF THE INVENTION

The invention reduces the difficulties and disadvantages of cryogenic liquid pumps and vehicle tanks by providing a cryogenic pump which can operate with negative inlet pressure, and by providing a vehicle tank which can be filled to its full capacity, without encroaching upon the ullage space, and provide automatic positive indication when the tank is full, and can stop the pump automatically when the tank is full. In addition, the pump can pump liquid or vapour or a mixture of both to deliver cryogenic liquid or vapour to a modified diesel engine or a natural gas burning engine requiring a fuel pressure higher than the vehicle tank pressure.

The advantages of the pump are attained by providing a relatively mechanically simple pump, with simple controls and construction, which can be easily installed above ground, or above the storage tank at a conventional cryogenic storage facility or fuelling station. Furthermore, with changes in design, the pump can be easily installed as an engine fuel pump e.g., an engine of a vehicle, so as to pump liquid and/or vapour from a vehicle fuel tank to fuel a natural gas burning engine of the vehicle. The cryogenic pump of the invention is a positive displacement pump which operates at an essentially constant rate of displacement except during stroke changeover, and creates an essentially constant driving pressure differential at the inlet, and thus eliminates the high frequency pressure fluctuations at the inlet of the prior art pump. As a consequence, the pump of the invention can operate at a negative inlet or feed pressure, and yet produce high discharge pressures and high flow rates. The use of a negative inlet pressure permits an LNG storage tank to be buried in the ground, with the delivery pump of the invention mounted above the ground for ease of service safety and compliance with zoning bylaws. The high delivery pressure and volume flow rate from the pump considerably reduce fuelling time and essentially eliminates venting problems associated with prior art fuelling stations.

The rate of delivery of cryogenic liquid from the pump according to the invention is such that time for fuelling is considerably less than with prior art applications, even when using conventional cryogenic liquid vehicle tanks. However, preferred use of the cryogenic pump of the invention is to fill a vehicle tank according to the invention, in which case the fuelling automatically stops when the tank is full with the correct amount of ullage space, in contrast to the fuelling being stopped when the operator thinks the tank is full. Also, venting is essentially eliminated and time for refuelling the vehicle is reduced very considerably.

The advantages of the tank of the invention are attained by providing a tank with separate liquid and vapour compartments, in which the liquid compartment can be safely filled to its full capacity, with the vapour compartment receiving any excess liquid. The invention also provides two independent means of detecting automatically when the tank is filled, and these means are independent of operator skill and occur when temperature and/or pressure sensors are triggered, which occurs when the tank is full. Thus, the hazardous prior art method of detecting when the tank is essentially full is not required, and the vehicle tank can be consistently filled within acceptable limits, thus reducing chances of the vehicle exhausting its fuel supply unexpectedly. Use of temperature and pressure sensors provides a simple, fail-safe means of preventing overfilling of the tanks, and several electrical switches must be closed before fuelling starts, thus preventing initiation of the fuelling operation if electrical contacts and mechanical connections are not completed. In addition, if required, a further visual means can be provided for the operator to ensure essentially completely safe operation of the apparatus. The invention also provides a means to stop the fuelling operation automatically if the fuelling pressure at the inlet to the tank exceeds working pressure of the tank. Also, pressure in the vehicle tank is quickly reduced during filling by mixing incoming cold liquid with vapour within the tank. This is achieved using a single liquid inlet/outlet conduit and thus heat transfer into the tank is not aggravated. In addition, if the liquid outlet conduit extending from the tank is ruptured outside the tank, there is an essentially immediate venting of vapour from the tank with a corresponding reduction in pressure and liquid discharged from the tank. This contrasts with the aforementioned hazards of rapid and essentially complete liquid discharge associated with rupturing a single inlet/outlet line of a prior art tank.

The present invention also simplifies design, installation and maintenance of a cryogenic fuel engine pump for a vehicle, and eliminates the need to locate the fuel pump within the cryogenic fluid vehicle tank. The fuel pump according to the invention can be located at a convenient position within the vehicle, outside the tank, thus facilitating design and access for service, as well as decreasing problems due to heat leak and venting of vapour as previously described. When the pump is used for supplying cryogenic fluid fuel to an engine, the fuel tank supplies the pump with cryogenic liquid or vapour fuel through separate conduits, from which the fuel, as either liquid or vapour, is automatically selectively drawn, depending on control signals. The supply of fuel to a vaporiser of the engine can thus alternate between liquid and vapour, thus permitting full utilization of fuel within the tank with a corresponding increase in the holding time of the tank and elimination of loss due to venting.

One aspect of the invention relates to a cryogenic fluid pump, and method of operating such a pump. The method of operating the fluid pump comprises the steps of:

communicating a cryogenic fluid source with a first chamber of a pump cylinder through an inlet conduit extending from the source to a first inlet port of the chamber;

executing an induction stroke at the pump by displacing a pump piston in the pump cylinder to reduce pressure in the first chamber to induct fluid in the inlet conduit through the first inlet port by removing vapour from the liquid in the inlet conduit at a rate faster than the liquid in the inlet conduit can vaporize by absorbing heat.

Preferably, the method is further characterized by displacing the piston at an essentially constant velocity throughout length of the induction stroke, so as to generate essentially steady state induction flow conditions for most of the induction stroke. Also, the method is preferably further characterized by inducting the fluid through the inlet port while producing negligible restriction of flow of the fluid from the inlet conduit. The method is preferably further characterized by initiating an induction stroke from a dead position of the pump piston which is closest to an outer end of the cylinder containing the inlet port, such that stroke displacement volume is at least two orders of magnitude greater than residual volume remaining in the cylinder when the piston is in the dead position. Preferably, when executing a single induction stroke, ratio of volumes of the inlet conduit to stroke displacement of the pump is within a range of between 1:10 and 1:1.

The cryogenic fluid pump according to the invention comprises a pump body, a pump piston, a drive means and fluid inducting means. The pump body has a hollow cylinder and first inlet and outlet ports communicating with the cylinder, the inlet and outlet ports having respective inlet and outlet valves to control fluid flow relative to the ports. The pump piston is reciprocable within the cylinder to provide a first chamber to receive fluid from the inlet port during an induction stroke, and to discharge fluid through the outlet port during a discharge stroke.. The drive means is for driving the pump piston to execute the induction and discharge strokes, and cooperates with the pump piston. The fluid inducting means is for inducting fluid in an inlet conduit extending from a fluid source through the inlet port to the first chamber by removing vapour from the liquid in the inlet conduit at a rate faster than the liquid in the inlet conduit can vaporize by absorbing heat. Preferably, the drive means cooperates with the piston in such a manner as to displace the piston at an essentially constant velocity throughout length of the induction stroke to generate essentially constant steady state induction flow conditions for most of the induction stroke. An inlet conduit feeds fluid from the fluid supply to the inlet port and the fluid inducting means comprises the inlet port having a size, when opened, which is essentially equal to size of the inlet conduit so as to produce negligible restriction of flow of fluid into the cylinder. The piston has a dead position which is attained during a stroke changeover when the piston is closest to an end of the cylinder containing the inlet stroke. Stroke displacement volume is at least two orders of magnitude greater than residual volume remaining in the cylinder when the piston is in the dead position. Also, preferably the inlet conduit has a volume smaller than stroke displacement, so that ratio of volumes of the inlet conduit to the stroke displacement is within a range of between 1:10 and 1:1.

Another aspect of the invention relates to a tank for cryogenic liquid, and a method of filling the tank with cryogenic liquid from a cryogenic liquid supply. The method comprises the steps of:

coupling a supply conduit to a cryogenic liquid inlet conduit, the supply conduit cooperating with the liquid supply;

delivering the cryogenic liquid at a discharge pressure from the supply conduit to the liquid inlet conduit;

discharging the liquid into a liquid compartment of the tank at a pressure which is sufficiently high to widely disperse the liquid within the tank to increase chances of contact between the liquid and any vapour in the liquid compartment so as to condense most vapour therein, and when the liquid compartment is essentially full, conducting excess liquid from a position adjacent an upper portion of the liquid compartment to discharge the excess liquid to a vapour compartment.

The method is further characterized by restricting the flow of excess liquid from the liquid compartment to the vapour compartment when the liquid compartment is essentially full, and monitoring a pressure differential between the inlet conduit and the vapour compartment during delivery of the liquid into the liquid compartment. The method includes stopping supply of the liquid to the inlet conduit in response to a rise in the differential pressure.

The tank for cryogenic liquid comprises a fuel tank, an inlet conduit and an overflow conduit. The fuel tank has a liquid compartment to contain the cryogenic liquid and a vapour compartment to contain related cryogenic vapour. The inlet conduit sealably penetrates the liquid compartment and has an inlet discharge opening disposed to inject liquid into the liquid compartment so that the discharged liquid is sufficiently widely dispersed so as to increase chances of contact between the liquid and any vapour in the liquid compartment to condense most of the vapour in the liquid compartment. The overflow conduit has an overflow inlet disposed adjacent an upper portion of the liquid compartment, the overflow conduit sealably penetrating the liquid compartment and having an overflow outlet disposed within the vapour compartment.

The tank is further characterized by the overflow conduit having a cross-sectional area less than cross-sectional area of the inlet conduit to restrict flow of excess liquid in the overflow conduit, so as to develop a pressure rise in the liquid compartment when the liquid compartment is full. A differential pressure sensor cooperates with the inlet conduit and the vapour compartment to monitor differential pressure therebetween. The invention further includes means coupling the differential pressure sensor to controls of a cryogenic delivery pump supplying the liquid to the inlet conduit, so as to stop the delivery pump when a pre-determined rise in differential pressure is detected.

Another aspect of the invention relates to an apparatus and method for supplying cryogenic fluid fuel to an engine, the method comprising the steps of:

conducting cryogenic vapour from a fuel tank in a vapour conduit, conducting cryogenic liquid from the tank in a liquid conduit, and selectively receiving cryogenic liquid and vapour from the respective conduits at an inlet of a pump, and pumping cryogenic liquid to satisfy fuel demand of the engine, and when the fuel demand is satisfied, pumping cryogenic vapour to reduce vapour pressure in the tank.

The method is further characterized by temporarily storing the cryogenic fluid prior to supplying the fluid to the engine to permit the pump to be stopped, and monitoring pressure of the temporarily stored cryogenic fluid to detect when the pump should be restarted.

The apparatus for supplying cryogenic fluid fuel to an engine comprises a vapour delivery conduit, a liquid delivery conduit and a fuel pump. The vapour delivery conduit communicates with a cryogenic fluid fuel tank, and a vapour control valve controls flow through the vapour delivery conduit. The liquid delivery conduit communicates with the cryogenic fluid fuel tank, and a liquid control valve controls flow through the liquid delivery conduit. The fuel pump is for selectively receiving cryogenic liquid and vapour from the respective delivery conduits. The fuel pump pumps cryogenic liquid to satisfy fuel demand of the engine and pumps cryogenic vapour to reduce vapour pressure in the fuel tank when the fuel demand is satisfied. The apparatus is further characterized by a storage means for temporarily storing pressurized fluid prior to delivery, the storage means communicating with the fuel pump to receive pressurized fluid therefrom. The apparatus also has a pressure sensing means for monitoring pressure of the temporarily stored fluid, the pressure sensing means cooperating with the storage means. The apparatus also has a control means communicating the pressure sensing means with the fuel pump so that operation of the pump is responsive to pressure of the stored cryogenic fluid.

A detailed disclosure following, related to drawings, describes a preferred embodiment of apparatus and method according to the invention, which are capable of expression in apparatus and method other than those particularly described and illustrated.

DETAILED DISCLOSURE

Figure 1:
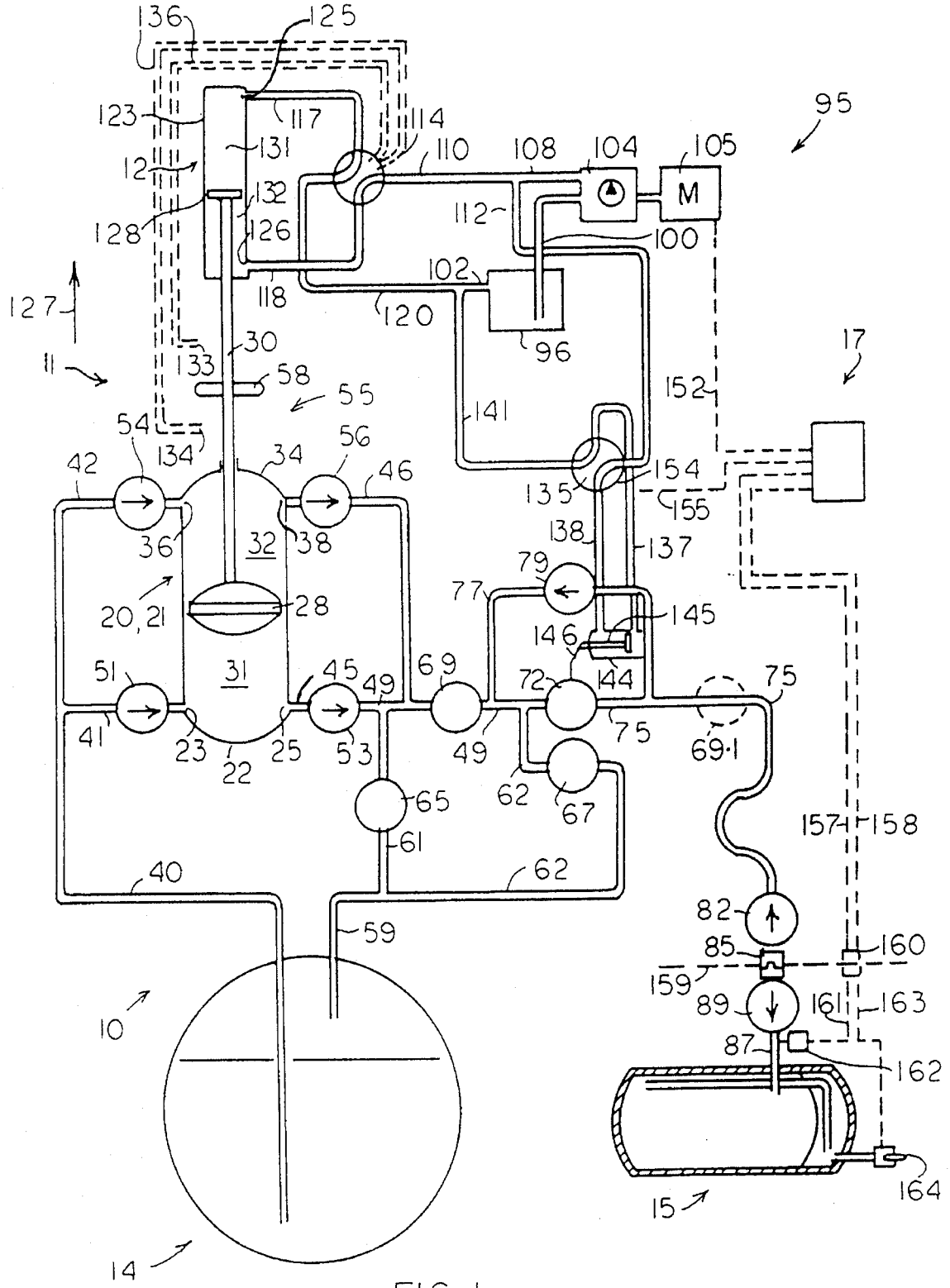
FIG. 1 is a simplified schematic of the invention showing conduits interconnecting a cryogenic fluid pump, a storage tank and a vehicle tank and associated sensors and controls.
Figure 2:
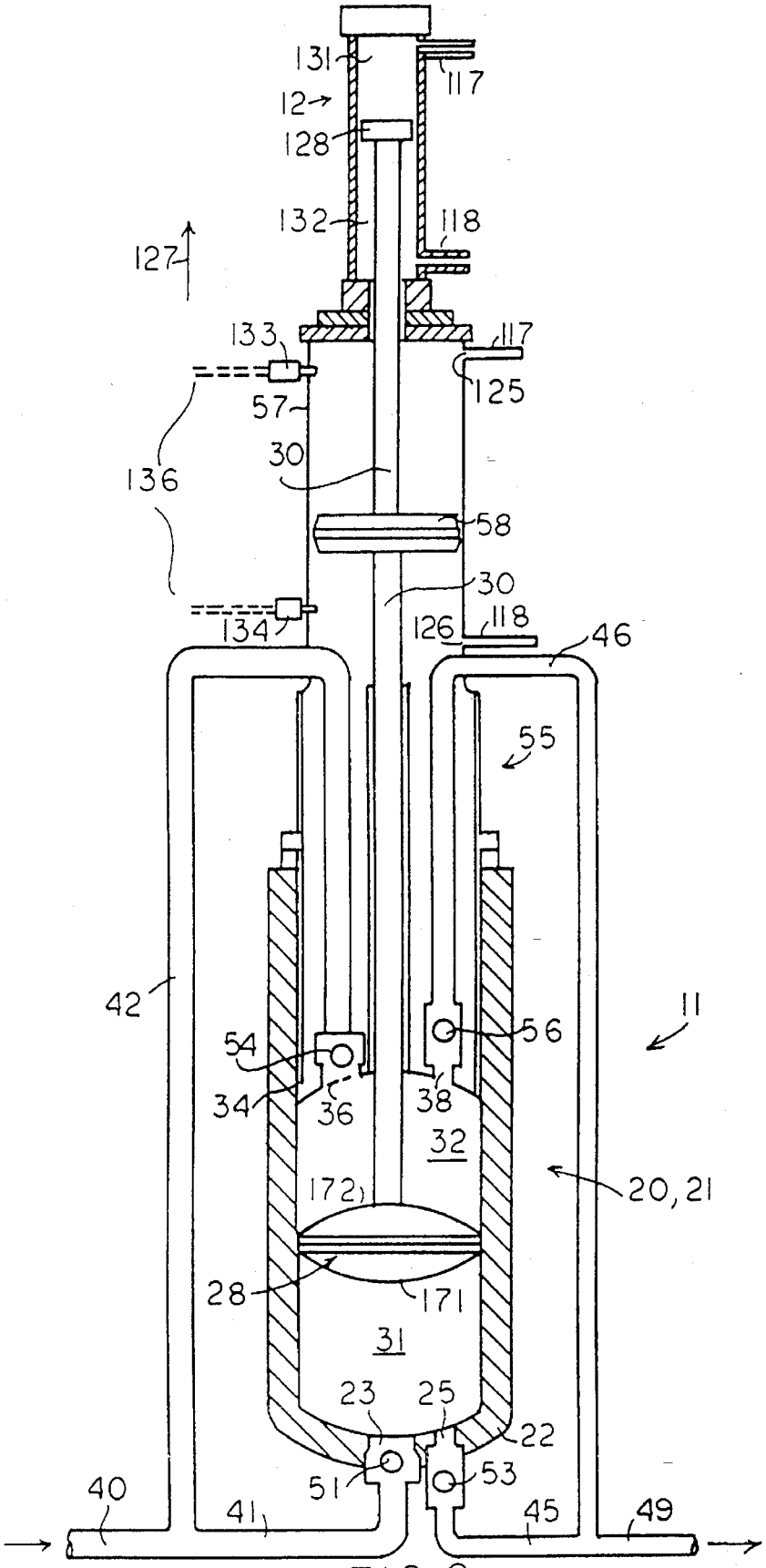
FIG. 2 is a simplified fragmented longitudinal section of the cryogenic fluid pump according to the invention with a hydraulic motor.

FIGS. 1 and 2

Most of the description following relates to a fluid circuit 10 of FIG. 1, although details specific to a cryogenic fluid pump apparatus 11 according to the invention are also shown in FIG. 2. The pump apparatus 11 is powered by a hydraulic motor 12 and dispenses cryogenic fluid from a storage tank 14 to a vehicle fuel tank 15, and is termed a dispensing pump. An electrical control unit 17 controls operation of some valves associated with a fluid circuit as will be described.

The pump apparatus 10 has a pump body 20 comprising a hollow pump cylinder 21 having a first end 22 provided with first inlet and outlet ports 23 and 25 communicating with the cylinder. The pump also has a pump piston 28 mounted on an end portion of a piston rod 30 so as to be reciprocable axially within the cylinder and to provide a first pump chamber 31 on one side of the piston and a second pump chamber 32 on an opposite side of the piston. The cylinder 21 also has a second end 34 having second inlet and outlet ports 36 and 38 on an opposite portion of the body from the first inlet and outlet ports. Thus, the pump piston divides the cylinder 21 into the first and second chambers 31 and 32 on opposite sides of the pump piston 28, with the first chamber communicating with the first inlet and outlet ports, and the second chamber communicating with the second inlet and outlet ports so that the pump is double-acting. As the piston rod 30 extends from one side only of the piston 28, the pump cylinder is unbalanced and thus displacement of the chamber 32 is somewhat less than that of the chamber 31, but this is immaterial and has negligible effect on the operation of the apparatus.

A main inlet conduit 40 leads from the storage tank 14 which provides a cryogenic fluid supply, and divides into first and second inlet conduit portions 41 and 42 respectively which communicate with the first and second inlet ports 23 and 36. Generally similar first and second outlet conduit portions 45 and 46 lead from the first and second outlet ports 25 and 38 respectively into a main outlet conduit 49 leading eventually to the vehicle tank 15 as will be described.

The first inlet and outlet ports 23 and 25 have respective first inlet and outlet check valves 51 and 53 respectively to control flow relative to the first chamber 31, and the second inlet and outlet ports 36 and 38 have similar second inlet and outlet check valves 54 and 56 respectively to control fluid flow relative to the second chamber 32. The pump piston 28 is reciprocable within the cylinder to receive fluid from respective inlet ports during an induction stroke in a specific chamber, and simultaneously to discharge fluid through the respective outlet ports during a discharge stroke in the opposite chamber.

As best seen in FIG. 2, portions of the second inlet and outlet conduits adjacent the ports 36 and 38 are mounted within an insulated intermediate portion 55 of the body between the cylinder 21 and the motor 12. An intermediate portion of the piston rod is sealed and insulated by this intermediate portion 55 and passes through a cam chamber 57 fitted between the motor 12 and the intermediate portion 55. A stroke change cam 58 is mounted on the piston rod 30 within the chamber 57 to move therewith.

A fluid return conduit 59 extends into the storage tank 14 and receives fluid from first and second return conduit portions 61 and 62 respectively. A LNG flow sensor 69 is provided in the main outlet conduit 49 to measure fluid flow from the pump and transmit resulting data to a read-out device as will be described with reference to FIG. 5B. The conduit portion 61 extends through a safety pressure relief valve 65 and connects with the main outlet conduit 49 to receive fluid which passes the valve 65 in an excess pressure condition. The second conduit portion 62 passes through a recirculating valve 67 which communicates with the main outlet conduit 49 in a "cool down or stand-by" mode, where the LNG fluid merely re-circulates between the pump and the tank 14.

A main delivery valve 72, when open in a "fuelling" or delivery mode, communicates the main outlet conduit 49 with a main delivery conduit 75 which can be considered as a continuation of the main conduit 49, delivery of fluid through the conduit 49 and 75 being controlled by the main valve 72. While the flow sensor 69 is shown located in the conduit 49, it could also be located in the conduit 75 as shown in broken outline in an alternative position at 69.1. Clearly, in the position as shown in full outline in the conduit 49, the sensor 69 would also be responsive to recirculating flow back into the tank 14, as well as to normal delivery flow, and thus would require resetting when delivery flow commenced. On the other hand, if the sensor 69 were located in the main conduit 75, it would only measure flow delivered to the tank 15. The valves 67 and 72 are mechanically coupled to attain opposite modes simultaneously as will be described. A bypass conduit 77 communicates with the conduits 49 and 75 to bypass the main valve 72 and has a bypass check valve 79 to drain fluid under pressure and trapped in the conduit 75, which fluid drains back through the conduit 77 and into the conduit 62. Clearly, when the valve 72 is opened, there is no flow through the check valve 79.

The main delivery conduit 75 has a discharge outlet check valve 82 located adjacent a quick-releasable fluid conduit coupling 85. The check valve 82 is mechanically opened when the coupling 85 is engaged during fuelling, and automatically prevents unintentional flow when the coupling 85 is disengaged. The coupling 85 releasably interconnects the delivery conduit 75 to a vehicle tank inlet/outlet conduit 87, which is a single conduit communicating with the tank 15. The single conduit 87 is thus a dual purpose conduit which permits fluid to be both delivered into the tank, and drained or withdrawn from the tank as will be described. Use of a single conduit to serve both purposes is preferred to reduce heat transfer along the conduit into the tank and for simplicity. A vehicle tank inlet check valve 89 is used to prevent reverse flow outwardly through the inlet conduit 87 from the tank 15. Structure associated with the vehicle tank 15 will be described in greater detail with reference to FIGS. 3 and 4.

The hydraulic motor 12 is powered and controlled by a hydraulic motor circuit 95 which receives hydraulic fluid from a hydraulic fluid sump 96. The circuit 95 has a sump outlet conduit 100 and a sump return conduit 102 communicating with the sump. The hydraulic circuit 95 also has a hydraulic pump 104 driven by an electrical motor 105 to draw fluid from the sump and feed it into a pump outlet conduit 108 which divides into a delivery conduit 110 and a control conduit 112. The pump 104 has a variable delivery flow and is horsepower limited, i.e. the pump tries to operate at a constant horsepower. Thus, at low pumping resistance, output flow volume is relatively high, and vice-versa. Ratio of low flow to high flow can be between 1:2 and 1:3. A four-way, two-position, reversing hydraulic directional valve 114 cooperates with the delivery conduit 110, first and second motor conduits 117 and 118, and a return conduit 120. The first and second motor conduits 117 and 118 cooperate with opposite ends of a hydraulic motor cylinder 123 of the motor 12 through respective first and second motor ports 125 and 126 of the cylinder 123. The hydraulic cylinder 123 has a motor piston 128 connected to an end portion of the piston rod 30 remote from the pump piston 28 and is rigidly connected thereto and reciprocates in unison therewith through equal length strokes. With the valve 114 in the position as shown, the rod 30 moves in direction of arrow 127, and when the valve 114 is shifted to an opposite position, not shown, direction of the rod reverses. Thus, the hydraulic motor 12 serves as a drive means for driving the pump piston to execute the induction and discharge strokes, the drive means cooperating with the pump piston 28 through the piston rod 30. Similarly to the pump cylinder, the piston rod 30 extends from one side only of the motor piston 128, and thus the hydraulic cylinder is unbalanced, but this is immaterial as the difference in displacements in opposite strokes is negligible and has little effect on the operation of the device. Thus, the motor piston 128 divides the motor cylinder 123 into first and second motor chambers 131 and 132 which have almost equal displacements and are accessed through the first and second motor ports 125 and 126 respectively.

First and second hydraulic limit switches 133 and 134 are provided adjacent opposite ends of the cam chamber 57 to be contacted by the cam 58 to reverse stroke of the piston rod 30. The switches 133 and 134 are connected through a pair of hydraulic lines, designated 136, to the first directional valve 114, the hydraulic lines cooperating as an independent stroke control circuit to actuate the valve 114 between the two opposite positions in response to contact of the appropriate switch 133 or 134. Clearly, independent alternative means of actuating the valve 114 can be substituted. Positions of the limit switches are set to control ends of the strokes of the motor piston 128, and thus also ends of the strokes of the pump piston 28. The motor piston 128 has conventional means on opposite end faces thereof to prevent high impact when the piston 128 approaches the end of the cylinder 123. A small cushion cavity is provided in the end faces of the piston 128 and this is used to prevent heavy contact between the piston 128 and the ends of the cylinder. Thus, the limit switches are set so that the piston 128 lightly touches opposite ends of the cylinder 123, so as to essentially eliminate residual fluid at ends of the stroke. During initial setting of the switches, hydraulic pressure is monitored in the respective portions of the circuit cylinders to ensure the piston 128 actually touches the outer ends of the cylinder 123, which also ensures that the piston 28 touches ends of the cylinder 21. Accurate setting of the limits of the stroke of the motor piston 128 permits similar accurate setting of the ends of the pump piston 28 so as to minimize volume of residual fluid remaining at ends of the pump piston as will be described.

The hydraulic circuit 95 also has a second hydraulic directional valve 135 which is a solenoid actuated, four-way, two-position reversing directional hydraulic valve cooperating with the control conduit 112, first and second actuating conduits 137 and 138 and a control return conduit 141. The first and second actuator conduits 137 and 138 communicate with opposite ends of a valve actuator cylinder 144 which has a reciprocable piston and piston rod 145, an outer end of the rod 145 being connected to mechanical linkages 146 to actuate the recirculating valve and main delivery valves 67 and 72 in opposite modes as will be described. The control return conduit 141 communicates with the return conduit 120 and, when the valve 135 is in the position as shown, also communicates with the first actuator conduit 137. When the valve 135 is in the position as shown, the control conduit 112 feeds fluid into the second actuator conduit 138 and then into the actuator cylinder 144. The conduits 137, 138 and 141 together with the valve 135 and the actuator cylinder 144 are portions of a hydraulic actuator system which controls operation of the valves 67 and 72, which are always set in opposite modes. While the actuator cylinder 144 is shown as double-acting, a single acting, spring-return actuator cylinder, or other valve actuating means could be substituted.

The hydraulic motor 12 is powered by the electrical motor 105 which is controlled by the electrical control unit 17 through electrical motor leads 152. Directional valve electrical leads 155 are shown schematically to extend from the unit 17 to a fill solenoid 154, which is connected to the valve 135 for controlling direction of flow through the valve 135 and hence actuation of the cylinder 144. When the solenoid 154 is not energized, the recirculating valve 67 is open and the delivery valve 72 is closed, and when the solenoid 154 is energized, positions of the recirculating valve and main delivery valve 67 and 72 are reversed. Delivery conduit coupling leads 157 and 158 extend schematically from the unit 17 and pass through releasable contacts of a quick releasible electrical coupling 160 in which contact is made or broken essentially simultaneously with connecting or releasing the quick releasible conduit coupling 85 of the delivery conduit leading fluid to the tank 15. In practice, the leads 157 and 158 pass along the conduit 75, and preferably the electrical coupling 160 is integrated into the fluid coupling 85. A broken line 159 represents a diagrammatic boundary between structure associated with the dispensing station and the vehicle. The lead 157 is releasably connected by the coupling 160 to a pressure lead 161 which cooperates with a pressure sensor 162 which is exposed to pressure in the vehicle tank 15 and is shown simplified in FIG. 1. It represents one pressure sensor which can measure a differential pressure, and a second pressure sensor which can measure gauge pressure, as will be described with reference to FIG. 3. The lead 158 is similarly releasably connected by the coupling 160 to a temperature lead 163 which is connected to a temperature sensor 164 monitoring temperature within the vehicle tank 15. More details of the control unit 17 and its cooperation with the apparatus are found in the description of FIGS. 5A and 5B.

As best seen in FIG. 2, the pump piston 28 has first and second piston end faces 171 and 172 which are convex and generally complementary to concave faces of the first and second ends 22 and 34 of the cylinder 21 so as to provide a "dead space" or residual volume at the end of the piston stroke of minimal volume. The dead space of the first chamber is manifested by a small distance, not shown, between an outer end of the first chamber containing the ports, and a closest or dead position of an adjacent face of the pump piston where the piston is momentarily stationary between strokes, i.e. at a stroke changeover position. Thus, the dead position is the closest position to the outer end of the first chamber that is attained by the piston during a stroke changeover, i.e. a change from a discharge stroke to an induction stroke and vice versa. The stroke changeover occurs in a very short time space while the piston is momentarily stationary, and preferably any residual liquid or vapour remaining in the dead space is minimal for reasons to be described. While the piston end faces are shown convex and the oppositely facing, complementary cylinder end faces are shown concave, clearly the piston and the complementary cylinder faces could be flat. With either type of face, volumes of the inlet and outlet ports on sides of the respective valves adjacent the cylinder are as small as possible to keep the residual volume of the dead space to a minimum. Thus, when the piston is in the dead position, residual volume remaining in the cylinder is as small as possible. For example, stroke displacement volume is preferably at least two orders of magnitude greater than the residual volume, that is stroke displacement volume is at least one hundred times greater than the residual volume. For better performance, stroke displacement volume could be three orders of magnitude greater, that is a thousand times greater, than the residual volume.

Also, there is an important relationship between stroke displacement of the pump and volume of fluid in the inlet conduit which results in a rapid pressure drop in the inlet conduit during an induction stroke, particularly before liquid flow has started. Preferably, total volume of the conduit portions 41 and 42 and associated main inlet conduit 40 leading from the storage tank 14 is considerably smaller than the displacement of a chamber of the pump. Preferably, ratio of total volumes of the inlet conduits to displacement of the pump is within a range of between 1:10 and 1:1.

In addition, it is noted that the first and second inlet conduit portions 41 and 42 have a cross-sectional size essentially equal to that of the main inlet conduit 40, and also to net clearance of the first and second inlet ports 23 and 36 when open. Thus, when the first inlet check valve 51 is open, flow through the first inlet port into the first chamber is essentially unrestricted by the inlet valve to produce negligible metering or change in pressure of the flow as it passes through the inlet valve. The second inlet port 36 and associated inlet check valve 54 are essentially identical to the first. In contrast, the first and second outlet conduit portions 45 and 46 are of smaller cross-sectional size than the corresponding inlet conduit portions 41 and 42, and the sizes of the outlet ports 25 and 38 and corresponding check valves 53 and 56 are correspondingly smaller. This is because the outlet flow is at considerably higher pressure and velocity than the inlet flow, and also flow restrictions through the outlet port are less critical.

Also, to attain some benefits of the invention, the piston 28 and the chambers 31 and 32 are sized so that a single stroke of the piston represents a substantial portion of the volume of the fuel tank 15. For example, a large 100 gallon (400 liter) fuel tank may be theoretically filled in approximately 7 complete strokes of the pump, (i.e. return or double strokes, or twice pump/stroke displacement), although for different pumps the range of complete strokes can be between 3 and 25. Examples of sizes of important components and operating parameters are discussed later.

Figure 3:
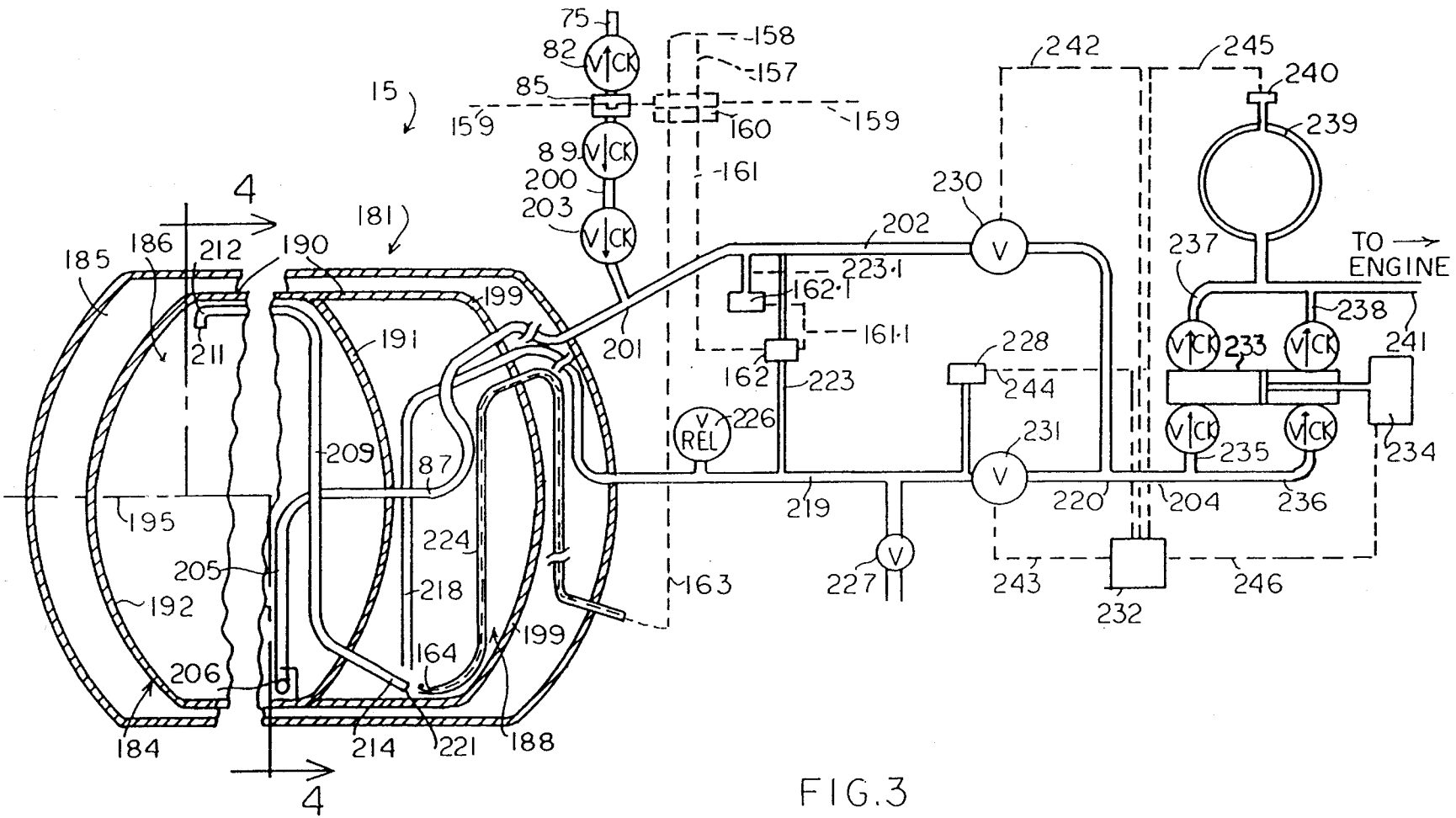
FIG. 3 is a simplified, fragmented longitudinal section through a vehicle tank and an associated engine fuel pump according to the invention, showing one means of discharging incoming liquid into the tank and some electrical connections to control elements.
Figure 4:
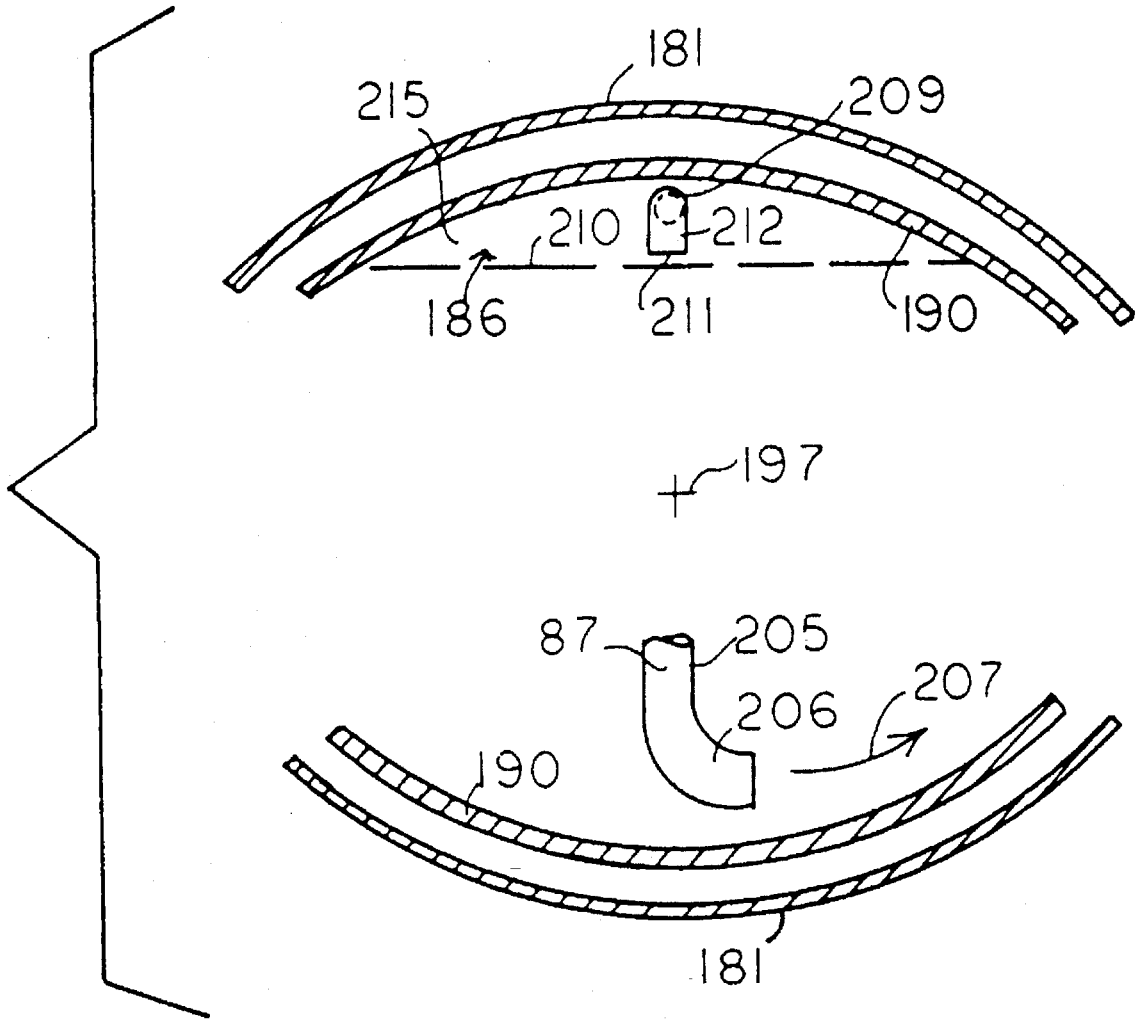
FIG. 4 is a simplified, fragmented transverse section on a staggered section line 4—4 of FIG. 3, showing details of an overflow inlet portion, and an inlet discharge portion.

FIGS. 3 and 4

The vehicle fuel tank 15 comprises an outer cryogenic tank 181 which is supported in the vehicle by structure, not shown, and supplies fuel to an engine (not shown) of the vehicle, via a fuel pump as will be described. Portions of the releasable conduit coupling 85 and electrical coupling 160 are disposed outwardly of the outer tank 181.

The vehicle tank 15 further comprises an inner tank 184 which is suspended, by structure not shown, within the outer chamber in a manner normally used in the cryogenic industry. A space 185 between the inner and outer tanks is used for standard cryogenic insulation, and is evacuated to a high vacuum. The inner tank 184 comprises a liquid compartment 186 to contain cryogenic liquid, and a vapour compartment 188 to contain related cryogenic vapour, the compartments having a cylindrical side wall 190 being separated by a bulkhead 191. The liquid compartment 186 has a liquid compartment or tank end wall 192, and the vapour compartment 188 has a vapour compartment or tank end wall 199. The side wall is of circular cross-section and concentric about a horizontal main tank axis 195. The vapour compartment 188 has a volume which is between about 10% and 15% of the volume of the liquid compartment 186, to provide a controlled "ullage" volume as will be described. Hereinafter, and in the claims, the terms "liquid compartment" and "vapour compartment " are for ease of identification only, and do not limit the contents of the compartments. Thus, the liquid compartment essentially always also contains some vapour in a vapour space above the liquid surface, and the vapour compartment sometimes contains liquid at least temporarily, when the liquid compartment is filled.

A plurality of conduits sealably penetrate the spaced apart end walls of the tank 181, the tank 184, and the bulkhead 191 as shown. Following conventional cryogenic practice, portions of the conduits passing through the space 185 are coiled in a manner to provide a sufficiently long length to provide a thermal barrier to restrict flow of heat into the inner tank 184. The relatively long lengths of conduit are not shown for clarity, and instead the conduits are shown broken. The inlet/outlet conduit 87 shown schematically in FIG. 1 is shown in greater detail in FIG. 3 as follows. An inlet connecting portion 200 extends from the inlet check valve 89 to a junction 201 with the inlet/outlet conduit 87 and a liquid delivery conduit 202. The liquid delivery conduit 202 extends from the conduit 87 and carries cryogenic liquid and passes to a main delivery line 204 extending to a fuel pump and eventually to the engine, as will be described. If the portion 200 is relatively long, an additional inner check valve 203 is located adjacent the junction 201 so as to reduce the amount of fluid loss that could otherwise occur if the line 200 was fractured in an accident. The inlet/outlet conduit 87 has an inner end portion 205 having a discharge elbow portion 206, best seen in FIG. 4. The inner end portion 205 extending from the elbow portion 206 is inclined vertically and generally radially of the axis 195, and the elbow portion 206 is located closely adjacent a lower portion of the side wall 190 and inclined at about 90° to the radius of the tank so as to be generally tangential of the circular cross-section of the side wall. During filling, the elbow portion 206 serves as an outlet portion for the conduit 87, and liquid discharged from the elbow portion during filling is initially directed per an arrow 207, i.e. the flow is thus a generally circulating flow about the axis 195. As previously stated, to reduce heat transfer into the tank 15, the inlet/outlet conduit 87 is also used to draw fluid from the tank i.e. as an outlet conduit, and thus the elbow portion 206 is located as close to the bottom of the tank as possible to ensure full utilization of LNG within the tank. An alternative inlet/outlet conduit is described with reference to FIG. 7.

The vehicle tank further comprises an overflow conduit 209 having an overflow inlet portion 211 disposed adjacent an upper portion of the liquid compartment 186 remote from the inlet of the tank. As best seen in FIG. 4, the overflow inlet portion 211 has a downwardly facing inlet elbow portion 212 which is spaced as close as practical to an upper portion of the side wall 190, so as to provide a minimum volume or vapour space 215 above a liquid surface 210 within the liquid compartment, when the tank is essentially full with liquid. This is to minimize volume of any vapour within the liquid compartment, and does not serve as an ullage space which contrasts with prior art tanks as will be described. The conduit 209 extends from the inlet portion 212 adjacent the end wall 192 to pass horizontally along an uppermost portion of the side wall, and then diametrically downwardly and through an opening in the bulkhead 191. The conduit 209 thus sealably penetrates the liquid compartment to terminate at an overflow outlet 214 disposed within the vapour compartment 188. The overflow conduit 209 has a cross-sectional area considerably less than cross-sectional area of the inlet conduit 87 to restrict flow of excess liquid in the overflow conduit for reasons to be described. Preferably, ratio of cross-sectional areas of the overflow conduit 209 to the inlet/outlet conduit 87 is between 1:2 and 1:4, although for some applications the ratio could be greater. The temperature sensor 164 is located closely adjacent and below the overflow outlet 214 so as to be exposed to temperature of any liquid forced through the outlet 214 into the vapour compartment. The temperature sensor 164 is a thermocouple and the temperature lead 163 from the thermocouple passes through a tubular lead protector 224 to connect with the coupling 160 to cooperate with remainder of the electrical control unit as shown in FIG. 1.

The vehicle tank further comprises a vapour collecting conduit 218 which has an open lower end portion 221 adjacent a lower wall of the compartment 188 to communicate with the vapour compartment to conduct vapour therefrom into the fuel pump for delivery to the engine, as will be described. The conduit 218 sealably penetrates the outer and inner tanks and connects through a vapour delivery conduit 219 with the liquid delivery conduit 202 at a junction 220.

Figure 5A:
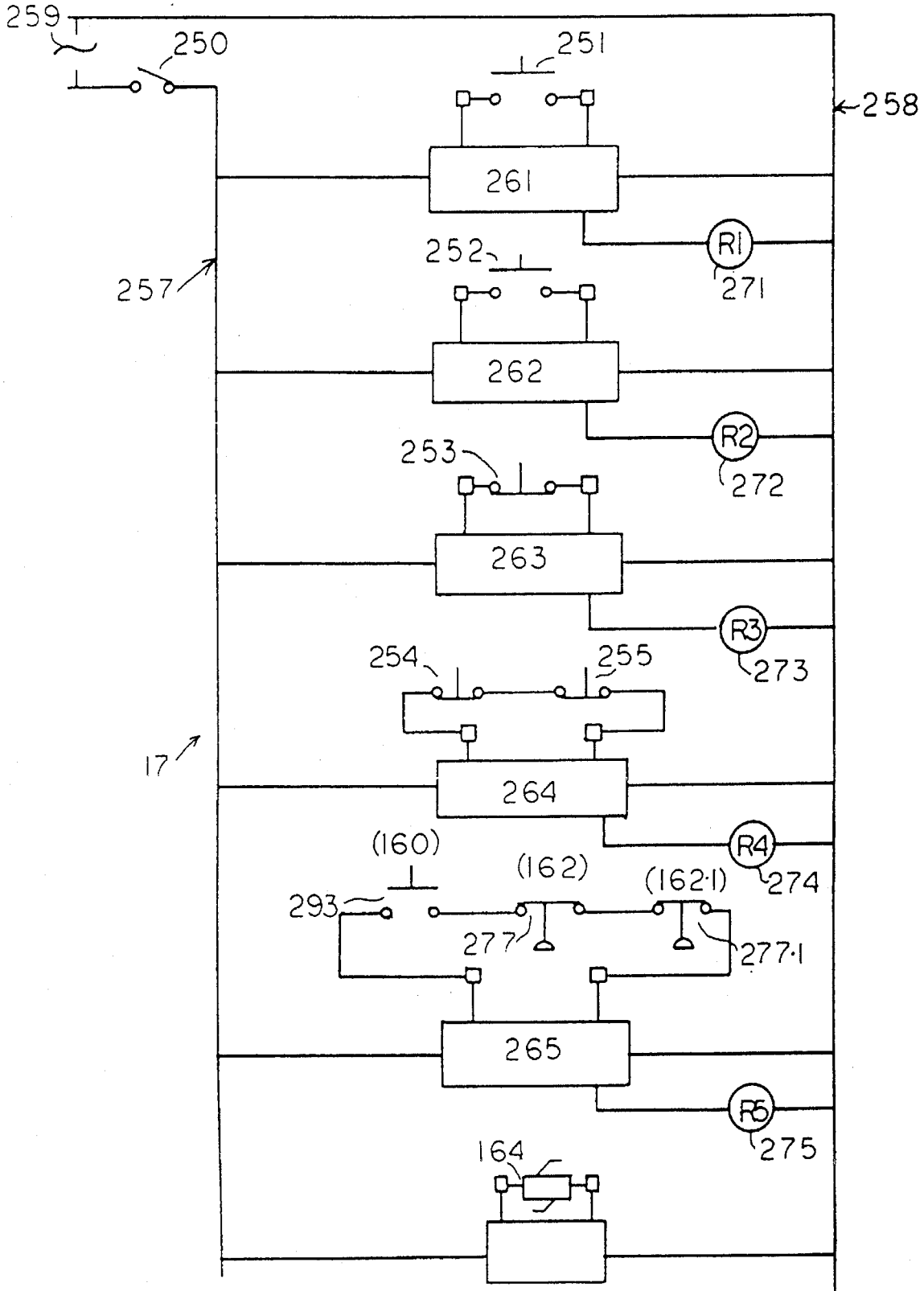
FIGS. 5A and 5B are interconnected simplified electrical diagrams showing main control components and sensors for controlling operation of relays and valves associated with the apparatus.
Figure 5B:
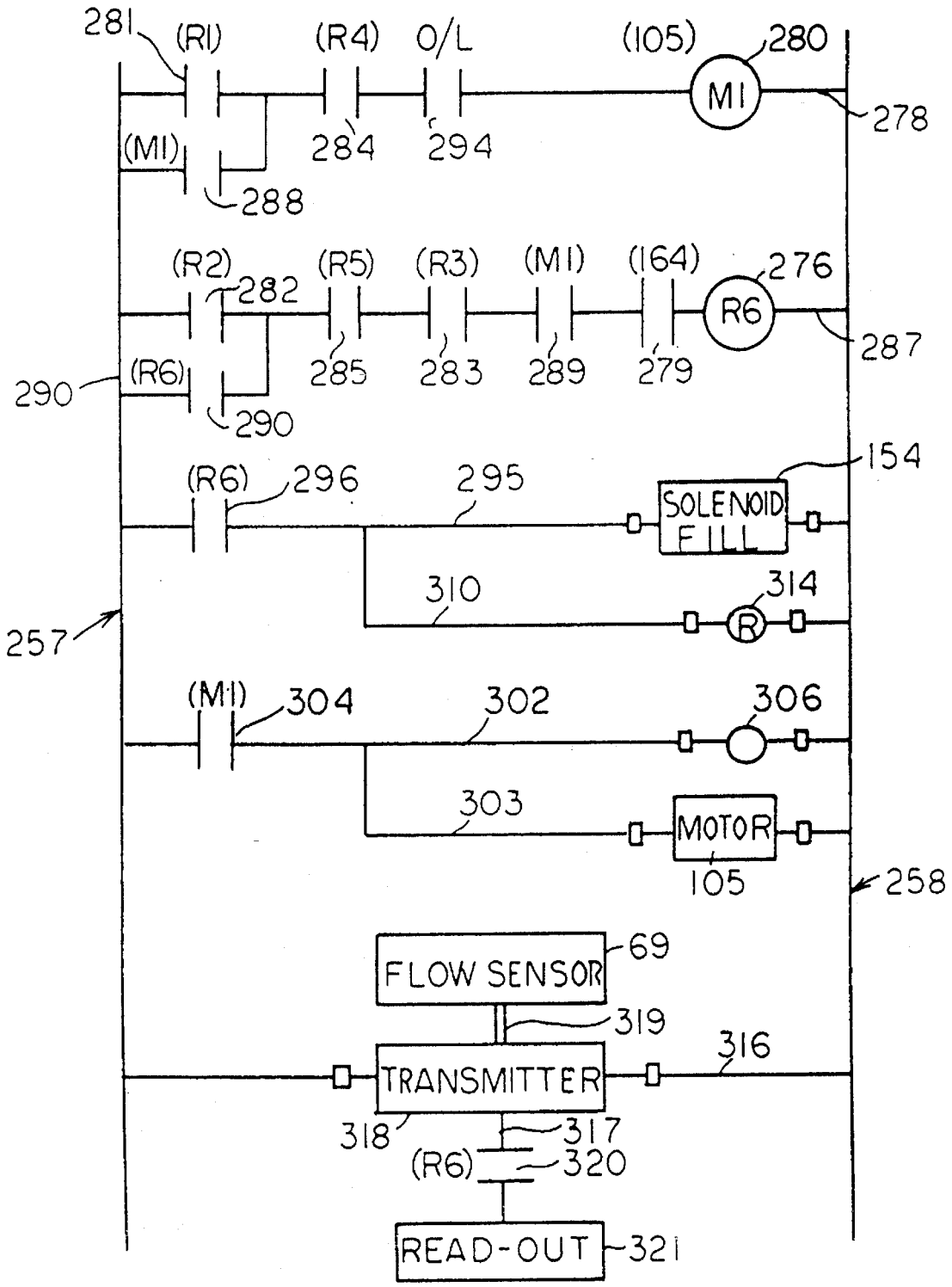

A differential conduit 223 extends between the liquid delivery conduit 202 and the vapour delivery conduit 219 and communicates with the pressure sensor 162 so as to monitor a pressure differential between the conduit 202, which carries cryogenic liquid, and the conduit 219, carrying cryogenic vapour. A normal differential pressure can be within a range of between 0 and 10 PSI (0 and 103 kPa) and is generally dependent on the ratio of cross-sectional areas of the conduits 209 and 89. The sensor 162 has normally closed electrical switch contacts which will open if a predetermined upper limit of differential pressure is reached, e.g. a pre-set limit of 5 PSI (34.5 kPa). The lead 161 extends from the sensor 162 through the electrical coupling 160 to connect with the lead 158 and the control circuit as shown in FIGS. 1, 5A and 5B.

Preferably, for additional protection, an additional gauge pressure sensor 162.1 is connected through a conduit 223.1, which in turn is exposed to liquid delivery pressure in the main delivery conduit 75 and the inlet/outlet conduit 87. The sensor 162.1 measures gauge pressure of liquid in the inlet conduit 200, via the junction 201, i.e. pressure measured with respect to ambient pressure. The gauge pressure sensor 162.1 protects the vehicle tank against excessive pressure delivered by the pump apparatus 11 and has normally closed contacts which open if a settable or pre-determined upper gauge pressure is reached, which pressure is equal to the maximum design pressure of the vehicle tank. The sensor 162.1 is connected electrically in series with the differential pressure sensor 162 by a lead 161.1. If the electrical contacts in either one of the two sensors is opened, delivery of LNG from the pump apparatus 11 will be stopped, as will be described. Because rate of volume flow from the pump apparatus 11 can vary considerably, premature triggering of the pressure sensors can occur, which would cause cut-off of the pump before the tank had been filled. To verify the tank has been filled, the operator can check a standard liquid level indicator, not shown, normally provided on the vehicle tank, or can restart the pump, which would again be immediately stopped if the tank had been completely filled, as is common practice with conventional automobile gasoline pumps.

A safety relief valve 226 and a manual venting valve 227 communicate with the vapour conduit 219 for safety, and to permit manual venting as required. It is added that should the vehicle stand for a long time and excess heat leaks into the inner tank 184, the liquid in the compartment 186 will expand and flow along the overflow line and eventually fill the vapour compartment 188, similarly to filling the ullage space of prior art tanks.

An electrically actuated liquid flow control valve 230 and a similar electrically actuated vapour flow control valve 231 cooperate with the liquid and vapour delivery conduits 202 and 219 respectively to control flow therethrough. The valves 230 and 231 are both normally closed when power to the circuit is cut, otherwise they are opened and closed in response to control signals from a fluid output control unit 232 as will be described. The tank and associated conduits as described above can be used for storage and delivery of fuel for all types of natural gas burning engines. In the following description, a fluid output control unit 232 controls operation of valves associated with the conduits, and a vehicle fuel pump for delivery of fuel to a high pressure engine fuel system requiring fluid at a relatively high pressure, that is higher than maximum operating pressure within the tank, typically within a range of between 300 and 3,000 PSI (2168 and 20,771 kPa).

A vapour pressure sensor 228 communicates with the vapour delivery conduit 219 and has normally open contacts which close as the pressure rises towards a maximum operating pressure of the tank. If the design pressure of the tank is 150 PSIG (1135 kPa), the pressure at which the contacts close, termed upper set point, may be set at 120 PSIG (928 kPa). In contrast, the contacts are set to open as the pressure falls towards a lower set point, typically about 75 PSIG (618 kPa). The sensor 228 outputs signals to the control unit 232, and establishes one of two conditions which must be satisfied before the valve 231 can open to deliver vapour, as will be described in greater detail with reference to FIG. 6.

The vehicle fuel pump 233 is functionally very similar to the pump apparatus 11 and thus can handle both phases of fluid and is not described in detail. The pump is driven by a hydraulic motor 234 which is generally similar to the hydraulic motor 12 of FIGS. 1 and 2. The hydraulic motor 234 is supplied with pressurized hydraulic fluid from a hydraulic pump, not shown, the pump being powered by an electric motor driven off the car battery, a drive belt from the engine, or other means, not shown. The pump has first and second inlet conduit portions 235 and 236 leading from the junction 220 through undesignated inlet valves. First and second outlet conduit portions 237 and 238 receive fluid through undesignated outlet valves and communicate with a surge tank 239 and a fuel system input line 241 which conducts pressurized fluid from the fuel pump 233 and the surge tank 239 to the engine. The surge tank 239 is fitted with a surge tank pressure sensor 240 which has normally closed electrical contacts which close when surge tank pressure is falling, at a lower set point which is a little above the minimum fuel pressure demanded by the fuel system. The electrical contacts open when the surge tank pressure is rising, at an upper set point which is below design pressure of the surge tank. A vaporizer, not shown, is normally required for vaporizing and heating any fuel before feeding the fuel to the high pressure fuel system.

The fluid output control unit 232 is connected schematically through electrical leads 242, 243 and 244 to the liquid flow control valve 230, the vapour control valve 231 and the vapour pressure sensor 228 respectively. The control unit 232 is also connected schematically by electrical leads 245 and 246 to the surge tank pressure sensor 240 and to controls for the hydraulic motor 234 respectively. The control unit 232 and associated components will be described in greater detail with reference to FIGS. 5A, 5B and 6.

For many operating conditions requiring average fuel consumption, the liquid control valve 230 is open and delivers fuel in the liquid phase to the engine fuel pump 234 and only when both the fuel tank vapour pressure exceeds the upper set point, as measured by the sensor 228, and the surge tank pressure is sufficiently high for engine demand, as measured by the sensor 240, is vapour delivered to the vehicle fuel pump 233. Because the pump 33 can handle both cryogenic vapour and liquid, when the two conditions above are satisfied, the liquid is cut off and vapour substituted to reduce vapour pressure in the tank 15. This would not be possible with any prior art pump known to the inventor, which would have difficulty in handling both phases of cryogenic fluid.

FIGS. 1, 5A and 5B

The description following assumes that the gauge pressure sensor 162.1 is used in combination with the differential pressure sensor 162. The electrical control circuit 17 controls the starting and stopping of the electric motor 105, and position of the recirculating valve and main delivery valve 67 and 72 which are responsive to manual push buttons and to the differential pressure sensor 162, the high pressure sensor 162.1, the temperature sensor 164 and the electrical coupling 160. The electrical motor 105 and other related electrical components are controlled through an electrical logic circuit of FIGS. 5A and 5B. Following conventional practice, any components which might present an electrical spark hazard are shown in the FIGS. 5A and 5B adjacent small squares and are fitted within an explosion-proof enclosure, or alternatively they can be protected by other known means. The electrical control unit 17 receives power from a conventional power supply 259 through a field disconnect switch 250 and the unit 17 functions as follows.

Referring to FIG. 5A, there are five push buttons associated with operation of the control system, namely:

| Push Button | Function | Type |
|---|---|---|
| 251 | Start pump | Normally open (N/O) |
| 252 | Start fill | Normally open (N/O) |
| 253 | Stop fill | Normally closed (N/C) |
| 254 | Stop pump | Normally closed (N/C) |
| 255 | Remote emergency stop | Normally closed (N/C) |

The push buttons extend between live and neutral lines 257 and 258 which receive power from the power supply 259 when the switch 250 is closed. All the push buttons are associated with intrinsic barriers which provide a safety current limiter and activate associated relays, designated R as follows. Intrinsic barrier 261 is energized by the start pump push button 251 which in turn activates R1 relay 271. Intrinsic barrier 262 is energized by the start fill push button 252 and in turn actuates R2 relay 272. Intrinsic barrier 263 is energized by the stop fill push button 253 and in turn actuates R3 relay 273. Push buttons 254 and 255 are wired in series and actuate intrinsic barrier 264 which in turn actuates R4 relay 274.

In a normal situation when other signals are absent, intrinsic barrier 265 and associated R5 relay 275 are energized when complementary hose coupling conduits 293 of the electrical coupling 160, which connects the dispensing pumping apparatus 11 to the vehicle, are connected together. The contacts 293 are in series with a differential pressure switch 277, which in turn is responsive to a signal from the differential pressure sensor 162. The pressure switch 277 is a normally closed switch which opens above the pre-determined differential pressure. The contacts 293 and the switch 277 are also in series with a normally closed pressure switch 277.1 which in turn is responsive to a signal from the gauge pressure sensor 162.1 and opens above a pre-determined or set high pressure, as determined by vehicle tank operating pressure limit. The contacts 293 and the switches 277 and 277.1 must be closed to start the fuelling process. The R5 relay 275 will be de-energized if any of the following events occur during fuelling:

1. electrical supply to the circuit 17 is interrupted;
2. the pressure sensor 162 senses a high differential pressure between the liquid compartment and the vapour compartment in the vehicle tank, i.e. above the pre-determined differential pressure;
3. the pressure sensor 162.1 senses a high gauge pressure in the liquid compartment, i.e. above the pre-determined gauge pressure;
4. the electrical coupling 160 is disconnected.

If any one of the above events occur, the R5 relay 275 is de-energized and the pump mode is changed from fuelling to the cool down or recirculating mode.

The temperature sensor 164 (FIG. 1) in the vehicle tank 15 is connected through the temperature lead 163 (FIG. 1) to a normally closed temperature sensor switch 279 which opens in response to an excessive drop in temperature below a threshold. The switches 277, 277.1, 279 and 293 are connected so that an either excessively high pressure or excessively low temperature or disconnection of the coupling 160 will change the pump from the fuelling to the cool down mode until conditions have returned to their normal acceptable state. In general, the control system will revert from the fuelling mode to the cool down mode in circumstances indicating a full tank, disconnection of the line, or the pushbutton 253 is pushed. The system will be shut down totally, that is the pump apparatus 11 will stop operating, if either or both of the pushbuttons 254 or 255 are pushed.

Referring to FIG. 5B, in which the live and neutral lines 257 and 258 continue from FIG. 5A, a first connecting line 278 has in series a M1 motor relay 280 of the electric motor 105, a normally closed, conventional motor overload switch 294, normally open contacts 281 of the R1 relay 271, and normally open contacts 284 of the R4 relay 274. The contacts 281 of the R1 relay 271 are in parallel with relay contacts 288 of the M1 motor relay and are latched closed when the connecting line 278 is conducting.

A second connecting line 287 has in series normally open relay contacts 282 of R2 relay 272, normally open contacts 285 of the R5 relay 275, normally open contacts 283 of R3 relay 273, normally open contacts 289 of the M1 motor relay, normally closed contacts of the temperature switch 279, which is responsive to the temperature sensor 164 and the R6 relay 276. Normally open relay contacts 290 of the R6 relay 276 are in parallel with the contacts 282 of the R2 relay 272 so as to latch closed the contacts 282 as required.

A third connecting line 295 extending between the lines 257 and 258 has in series normally open relay contacts 296 of the R6 relay 276 and the fill solenoid 154 which actuates the valve 135 in FIG. 1 to interchange the recirculating valve 67 and the main delivery valve 72. A parallel line 310 extends from the connecting line 295 to a red indicator light 314 provided in series with the fill solenoid 154. The light 314 is lit when the fill solenoid is energized indicating that fluid is being delivered to the tank.

A fourth connecting line 302 includes in series normally open contacts 304 of the M1 motor relay 280 and a white indicator light 306 which indicates when the pump motor 105 and thus the apparatus 11 is operating. A parallel line 303 extends from the connecting line 302 to energize the motor 105 (FIG. 1).

A fifth connecting line 316 has a flow transmitter 318 which is connected through a dedicated cable 319 to the LNG sensor 69 of FIG. 1. The transmitter 318 is further connected by a line 317 through normally open contacts 320 of the R6 relay 276 to the "read-out" head 321 of the flow sensor 69 to indicate the amount of fluid which is transferred to the vehicle tank.

FIG. 6

The vehicle fuel pump 233 of FIG. 3 is controlled by the fluid output control unit 232 which has live and neutral lines 335 and 336 which receive power from a vehicle battery 337 through a main power switch 339.

A first connecting line 332 has in series normally closed contacts 334 of a switch associated with the surge tank pressure sensor 240 of FIG. 3 and a solenoid controlling the liquid flow control valve 230 of FIG. 3. The contacts 334 are termed "normally closed" as they are closed at any pressure below the lower set point as previously described. An R8 relay 338 is in a line 333 connected in parallel with the valve 230 and is energized when the valve 230 is energized.

A second connecting line 340 has in series normally open contacts 342 of a switch associated with the fuel tank vapour pressure sensor 228 of FIG. 3, normally closed relay contacts 346 of the R8 relay 338, and a solenoid controlling the vapour flow control valve 231 of FIG. 3. The contacts 342 are responsive to vapour pressure in the vehicle fuel tank, and are normally open at any pressure below the lower set point.

A third connecting line 347 has in series normally open relay contacts 348 of the R8 relay 338, and an R9 relay 349. An interconnecting line 351 extends between the lines 340 and 347 and connects a portion of the line 340 between the contacts 342 and 346 with a portion of the line 347 between the contacts 348 and the R9 relay 349.

A fourth connecting line 354 has in series normally open contacts 356 of R9 relay 349 and a vehicle pump motor relay 358 controlling the motor 234 of the vehicle fuel pump 233 of FIG. 3.

Dimensional and Operating Parameters

The following dimensional and operating parameters are assuming that the dispensing pump apparatus 11 is for dispensing LNG, which is primarily methane, which is normally preferably stored at temperatures of between −240° F. and −215° F. (−150° C. and −137° C.), and at a pressure of between 20 PSIG and 60 PSIG (239 and 515 kPa). A typical vehicle tank 15 will have a capacity of 30–100 gallons (100–400 liters) and would normally contain liquid at a temperature within the range of −240° F. and −200° F. (−150° C. and −130° C.), and at a pressure of between 20 and 150 PSIG (239 and 1135 kPa). For a vehicle tank having a capacity as above, in order to obtain a refuelling time of between 2 and 4 minutes, a flow rate of between 20 gallons per minute and 40 gallons per minute (80 liters per minute and 160 liters per minute) would be required.

To attain the above operating parameters, one example of the pump 11 has been constructed, and has a cylinder bore of 12.5 inches (318 mms.) and a piston stroke of 15 inches (381 mms.). Thus, displacement of the cylinder in one stroke is 1840.7 cu. inches (30,164 cu. cms.). The main inlet conduit 40, and inlet conduit portions 41 and 42 have a cross-sectional area of 1.78 sq. inches (1140 sq. mms.). The first and second inlet ports 23 and 36 are controlled by ball-check type inlet valves having a similar unrestricted area for passing fluid into the cylinder. The main outlet conduit 49 and outlet conduit portions 45 and 46 have cross-sectional areas of 0.78 sq. inches (507 sq. mms.) and the outlet ports 25 and 38 are controlled by ball-check type valves having correspondingly similar unrestricted cross-sectional areas.

The pump is usually operated at a relatively low frequency of about 2 return strokes per minute or at a relatively high frequency of about 5 return strokes per minute, although it could operate at frequencies of between 1 and 10 return strokes per minute. Hydraulic pressure fed to the hydraulic motor 12 is typically at about 1,000 PSI (6890 kPa). Following normal cryogenic practice, all cold fluid lines and structure associated with cold fluid, e.g. valves etc. are insulated. It is noted that the piston, being double-acting, does not require extensive insulation that would otherwise be required with a single-acting piston. Clearly, heat transfer from the hydraulic motor 12 into the pump apparatus 11 should be minimized by providing a long heat path of low conductivity materials.

In contrast, the vehicle fuel pump 233 is much smaller, and one example has a cylinder bore of 4.0 inches (100 mms.) and a piston stroke of 9.0 inches (230 mms.). Thus, displacement of the cylinder in one stroke is 113 cu. inches (1806 cu. cms.). The fuel pump 233 would operate at a low frequency of about 1 return stroke/minute and a high frequency of about 4 return strokes/minute to generate a flow rate of between 1 and 4 gallons per minute (4 and 16 liters per minute) to the engine.

OPERATION

Most of the following description relates to FIG. 1 showing the main schematic of the pump which has three basic modes as follows:

1) Off Mode

The main delivery valve 72 is closed and the recirculating valve 67 is open. Pressure in the first and second pump chambers 31 and 32 is equal to that in the storage tank 14.

2) Cool Down or Stand-by Mode

The motor 105 has been started by manually engaging the start pump push button 251 of FIG. 5A. In this mode, the pump draws cryogenic fluid from the storage tank 14 through the conduit 40, and circulates the fluid through the recirculating valve 67 and associated conduits 49, 62 and 59 to return the fluid to the storage tank 14. In this mode, the re-circulating fluid cools the pump and all associated piping so as to reduce or essentially eliminate formation of cryogenic vapour.

3) Fuelling Mode

In this fuel dispensing mode, the positions of the recirculating valve and main delivery valve 72 and 67 have been reversed, so that the valve 72 is now open to permit the pump apparatus 11 to dispense fluid to the vehicle tank 15. Before this can happen, various interlock and safety features must have been verified as will be described. The pressure relief valve 65 in the conduit 61 ensures that discharge pressure of the pump will be no higher than setting of the valve 65 and thus in normal operation, this valve is usually closed.

Under normal operating conditions, the remote field disconnect switch 250 is always closed, thus supplying power to the unit and the control unit 17 in particular. When power is supplied to the line 257, see FIG. 5A, the R3 relay 273 and the R4 relay 274 will be energized as the push buttons 253, 254 and 255 are normally closed. This in turn will close the R4 relay contacts 284 in the line 278, and the R3 relay contacts 283 in the line 287 (see FIG. 5B).

To attain the cool down mode from the off mode, the pump 11 is started by manually closing the push button 251 of FIG. 5A which energizes the R1 relay 271 through the associated intrinsic barrier 261. Relay contacts in the connecting line 278 are now closed, which through the closed contacts 284 and 294 supplies power to the M1 motor relay 280, which latches the contacts 288 and 304 closed, which starts operation of the hydraulic pump 104 with the motor 105 (FIG. 1) and energizes the white indicator light 306. The description following relates mostly to FIG. 1 and operation of the hydraulic motor 12 and pump 11, primarily shifting from the off mode to the cool down mode, but most of the description of the motor and pump applies equally to operation of the apparatus in the fuelling mode. The hydraulic pump 104 supplies pressurized hydraulic fluid through the directional valve 114 and the motor conduit 118 into the hydraulic motor 12. The pump piston 28 and thus the motor piston 128 are assumed to be at fully extended positions of their respective strokes, and the first pump chamber 31 is at minimum volume, and the second pump chamber 32 is at maximum volume. Thus, hydraulic fluid passes along the conduit 110, through the valve 114 and the conduit 118 into the second motor chamber 132, which is also at minimum volume. The piston rod commences to move in direction of the arrow 127, thus expanding the first pump chamber 31 and decreasing volume of the second pump chamber 32. Thus, cryogenic fluid is drawn through the first check valve 51 into the chamber 31 and exhausted through the second outlet valve 56 from the chamber 32.

Hydraulic fluid is fed into, and removed from, the motor 12 at an essentially constant rate throughout full length of stroke of the motor 12, thus moving the piston rod 30 at an essentially constant velocity from start to finish of the stroke. Thus, the hydraulic motor 12 serves as a drive means for driving the-pump piston 28 in such a manner that the pump piston 28 is displaced at an essentially constant velocity throughout length of the induction stroke, so as to generate essentially steady state induction flow conditions for most of the induction stroke of the pump as will be explained.

Assuming the pump has not been used for some time, initially the main inlet conduit 40 and the inlet conduit portions 41 and 42 will be relatively warm, and thus cryogenic liquid drawn into the conduits will evaporate and produce vapour, so that the pump is pumping mostly vapour, and consequently there will be little resistance to piston movement. As previously stated, the motor 105 has a horsepower limiter control with adjustable output volume, and the low power demand for pumping vapour results in the hydraulic motor being operated at a relatively high delivery rate, e.g. at a frequency of between about 4 and 6 return strokes per minute. This relatively high frequency of operation will continue until essentially all vapour has been displaced from the main inlet conduit and inlet conduit portions. As will be described later, the liquid in the inlet conduit 40 has a temperature and corresponding pressure below that in the storage tank 14.

Liquid from the conduit portions 41 and 42 starts to be drawn into the inlet ports, which increases load on the pump cylinder, which is reflected by increased load on the hydraulic motor. This causes a rise in horsepower demand in the motor circuit and speed of operation of the hydraulic motor is decreased, causing the liquid delivery pump to operate at a relatively low frequency of between about 2 and 3 return strokes per minute. Thus, the controls of the dispensing pump are responsive to power demand of the hydraulic motor circuit, and the delivery pump apparatus 11 has a relatively high operating speed which is used when the power demand in the hydraulic motor circuit is relatively low, which occurs when purging the pump system of vapour, and a relatively low operating speed which is used when the power demand in the hydraulic motor circuit is relatively high. Even the relatively high speed of operation, 4 to 6 strokes/minute, is a considerably lower frequency than the prior art crankshaft driven piston pumps operating at 200–500 RPM, and thus the high frequency pressure fluctuations at the inlet ports of the prior art pumps are eliminated, and the invention provides a steady state inflow conditions for a relatively long stroke cycle time.

As previously described, there is essentially negligible difference in cross-sectional area through an open inlet valve and the adjacent inlet conduit portion and inlet port, and thus fluid is inducted through the inlet port while producing negligible restriction of flow of the fluid from the inlet conduit. The negligible restriction of inlet flow, termed negligible throttling of inlet flow, results in negligible pressure differential of fluid flow across the inlet port, and thus there is a negligible tendency to vaporize the fuel. Thus, once the pump and associated conduits have been cooled to an equilibrium temperature, there is little tendency for liquid to be vaporized at any stage during an induction stroke. However, there may be some initial minor vaporization of residual liquid in the dead space, which vaporization can occur when the stroke is initiated from a dead position closest to the outer end of the cylinder containing the inlet port. The volume of the dead space includes that associated with the ports, but this is essentially negligible when compared with the volume of displacement of the chamber or cylinder. Thus, any liquid remaining in the dead space is essentially eliminated during initiation of the stroke, and thus produces negligible vapour pressure due to the rapid inwards flow of liquid as the stroke is initiated. This results in the piston being displaced in an induction stroke so that essentially all cryogenic liquid being drawn through the inlet conduit and the inlet port is maintained as a liquid and has an essentially constant pressure with respect to time and represents the previously described essentially steady state induction flow conditions.

It is added that fluid in the main inlet conduit 40 is insulated from ambient heat, either by the surrounding liquid in the storage tank 14, or by structural insulation. Thus, as the chamber 31 expands and pressure is lowered in the chamber 31 and the conduit 40, the liquid in the conduit 40 starts to boil due to reduced pressure, and heat is required to sustain the boiling. The insulation prevents heat from being absorbed, and thus temperature of the liquid is decreased, thus causing the liquid to boil at a lower pressure than the liquid in the storage tank 14, which generates a pressure difference causing liquid to be forced up the conduit 40 from the tank. The relatively large displacement of the pump is considerably larger than total volume of vapour in the inlet conduit and the inlet conduit portions and thus any vapour generated by boiling is quickly removed, usually by relatively few induction strokes of the pump.

Because the vapour can be removed faster than it is generated, it can be seen that the pump can draw liquid up the conduit 40 into the chamber, without requiring a positive feed pressure as is required in the prior art. In some applications, with the pump having the operating parameters as described, the pump was located 30 ft. (10 meters) above the surface of liquid in the storage tank, and was able to draw fluid against this negative head or negative feed pressure. In applicant's opinion, no other cryogenic piston pump or centrifugal pump can function in this manner, and the success of the present invention is attributed to the ability of the pump to produce relatively steady state induction flow conditions, with negligible throttling of inlet flow and without relatively high frequency reversals of pressure or pressure fluctuations within the main inlet conduit 40 or inlet conduit portions 41 and 42. As previously stated, these relatively high frequency pressure fluctuations occur with a faster operating, relatively small displacement, prior art multi-cylinder reciprocating feed pump, which therefore, when used in cryogenic applications, requires a positive feed pressure. The relatively large displacement of the present dispensing pump compensates for the relatively slow velocity of the piston as it executes an induction stroke, and thus a reasonable practical delivery volume of fluid can be achieved notwithstanding a relatively slow reciprocating speed. As previously stated, the relatively large displacement of the pump permits use of relatively large inlet ports and valves, which can be approximately equal to the size of the inlet conduit portions, thus contributing to negligible inlet flow throttling, again in contrast with the small inlet valves of the cylinders found in the prior art.

Thus, the method of the invention involves executing an induction stroke of the pump by displacing the pump piston in the pump cylinder to reduce pressure in the first chamber to induct fluid in the inlet conduit through the first inlet port by removing vapour from the liquid in the inlet conduit at a rate faster than the liquid in the inlet conduit can vaporize by absorbing heat, thereby creating a pressure difference which forces liquid into the pump chamber.

Because the pump is double-acting, simultaneously while executing an induction stroke in the first chamber on a first side of the piston, a discharge stroke is executed on an opposite second side of the piston in the second chamber. Clearly, the uniform velocity of the piston in the induction stroke is reflected in the discharge stroke also. Thus the discharge stroke is executed by displacing the piston within the chamber at an essentially constant velocity to generate an essentially instantaneous and relatively high discharge velocity in an outlet flow in the outlet conduit portion 46 leading from the chamber. The discharge velocity is relatively high due to the relatively small size of the outlet conduits and the ability of the piston pump to provide high discharge pressure. The discharge pressure is essentially constant and sufficiently high to essentially eliminate vaporization of liquid in the outlet conduit, even if the liquid is heated by contact with warm valves or conduits etc. at the start of the cool down mode. In addition, during the fuelling operation, when the fluid passes through the control valves and the delivery conduit 75, the high discharge pressure and high fluid flow velocity provide additional advantages in that a relatively large volume of cold liquid is forced quickly into contact with warmer components, and heat from the warmer components is distributed into a relatively large volume of liquid, which produces a correspondingly smaller temperature rise than if the same amount of heat were distributed into a smaller volume of liquid. This in turn produces less vapour in the inlet conduit or tank, further reducing pressure rise due to vapour generated by contact of the liquid with warm surfaces. With the sample of the invention described above, a single discharge stroke discharges a volume of liquid into the tank to attain a discharge velocity of between about 10 and 40 ft. per second (about 3 and 13 meters per second) to ensure relatively fast delivery of fluid into the vehicle tank as will be described.

The piston rod continues moving at a generally uniform velocity in direction of the arrow 127 until the cam 58 actuates the limit switch 133 which generates a hydraulic pilot signal to reverse orientation of the valve 114, which interchanges connections between the conduits as shown in FIG. 1. Thus, in the second position, not shown, of the valve 114, the conduit 110 feeds fluid under pressure into the first motor conduit 117 and into the first motor chamber 131, and fluid is scavenged from the second chamber 132 through the conduit 118 which is now connected to the conduit 120, feeding fluid back to the sump 96.

The first motor chamber 131 now commences to expand, while simultaneously reducing volume of the second pump chamber 132 and moving the piston rod 30 in a direction opposite to the arrow 127. Clearly, this causes a corresponding reversal of stroke in the pump cylinder 21 so that the second pump chamber 32 now executes an induction stroke, and the first pump chamber 31 executes a discharge stroke. It can be seen that the limit switches 133 and 134 serve as stroke changeover means to reverse stroke of the pump piston. Clearly, the interval of time required for interchanging the conduits with the main directional valve 114 can be relatively short, which results in the stroke changeover occupying a relatively small interval of time, i.e. stroke reversal is essentially instantaneous. Initially, while the pump 28 executes an induction stroke, the main inlet conduit 40 and the inlet conduit portion 41 are exposed to low pressure and fluid flows along the conduit 40 and portion 41 into the chamber 31. Following the stroke changeover, the conduit portion 41 is closed and the inlet conduit portion 42 is open and now subject to low pressure, and thus fluid flows from the main conduit 40 directly into the conduit portion 42. Thus, momentum of inlet flow in the conduit 40 due to low pressure in the conduit portion 41 is maintained essentially constant, but with a momentary pause when the low pressure is quickly switched to the conduit portion 42 following stroke changeover. Thus, inlet flow of fluid in the main inlet conduit 40 is essentially uninterrupted during stroke changeover, which provides an increase in efficiency over a single-acting pump, in which half a cycle of the pump is inactive for an induction stroke and momentum of inlet flow would be lost. When the pump is double-acting, induction and discharge strokes alternate on opposite sides of the piston, so that at any moment an induction stroke takes place simultaneously with a discharge stroke. While the simultaneous strokes clearly improve efficiency considerably, an additional benefit is attained which results from maintenance of an essentially constant flow of fluid in the main inlet conduit leading from the fluid source, with only momentary pauses during stroke changeovers. This essentially constant speed flow results from maintenance of a pressure differential between the pump and storage tank 14 which maintains momentum of flow in the main inlet conduit and facilitates maintenance of steady state induction flow conditions even shortly after a stroke changeover. This essentially undisturbed flow of fluid into the pump also results from reversing direction of displacement of the pump piston essentially concurrently with reaching an end of an induction stroke in the first chamber, and essentially immediately thereafter, commencing an induction stroke in the second chamber. Thus, the stroke changeover occurs essentially instantaneously when the piston attains a dead-end position of the stroke, and the relatively slow speed of the piston facilitates the stroke changeover.

The above description relates to normal operation of the pump which occurs during the cool down mode, or the fuelling mode. Clearly, in the cool down mode, simple circulation is maintained between the pump and the storage tank 14 through the conduits 40 and 59 and inter-connecting conduit portions and the open recirculating valve 67. To manually stop operation of the pump in the cool down mode, referring to FIG. 5A, either of the stop buttons 254 or 255 is first opened, which through the barrier 264 de-energizes the R4 relay 274, which opens the contacts 284 in the line 278, which in turn de-energizes the M1 relay 280 (FIG. 5B), which opens the contacts 288 and 304 and cuts power to the electric motor 105 in the line 303 and the light 306.

Before shifting into the fuelling mode from the cool down mode, the fluid coupling 85 is engaged, which simultaneously opens the check valve 82 by a simple mechanical displacement as is well-known. Simultaneously with engaging the coupling 85, the electrical coupling 160 is engaged which completes the electrical connections between the leads 157 and 161, and the leads 158 and 163, as illustrated by closing the contacts 293 (FIG. 5A) of the coupling 160. As there will be no differential pressure between the liquid and vapour compartments 186 and 188 (FIG. 3), the contacts of the switch 277 of the differential pressure sensor 162 will be closed. Similarly, the high pressure or gauge pressure sensor 162.1 will be exposed to a pressure lower than the upper set point pressure of the sensor, and the contacts of the switch 277.1 will also be closed. Thus, all contacts in the line connecting the barrier 265 will be closed, and thus power will be supplied to energize the R5 relay 275, which in turn will close the relay contacts 285 in line 287 of FIG. 5B. The temperature sensor 164 will be exposed to a temperature above the low set point and contacts of the switch 279 (FIG. 5B) will be closed. Because the M1 relay 280 is energized, contacts of the motor relay contact 289 are closed, and thus the contacts 285, 283, 289 and 279 on the line 287 are all closed, leaving only the R2 relay contacts 282 open.

The pump is now switched to the fuelling mode by pressing the startfill push button 252 (FIG. 5A) which energizes the R2 relay 272 which in turn closes the relay contacts 282 and energizes the R6 relay in the connector line 287 (FIG. 5B), as the remaining contacts 285, 283, 289 and 279 are all closed. This in turn latches the contacts 290 of the R6 relay 276 which maintains the line 287 energized. Similarly, the contacts 296 of the R6 relay 276 are closed, which in turn supplies power to the fill solenoid 154 which also energizes the red indicator light 314. Thus, referring to FIG. 1, a fill solenoid signal is generated from the control unit 17 and interchanges the position of the valve 135. This in turn, actuates the valve actuator cylinder 144 to reverse the condition of the recirculating valve and main delivery valve 67 and 72, so that the recirculating valve 67 is now closed, and the valve 72 is now open. Fluid then passes from the conduit 49 through the valve 72 into the delivery conduit 75 through the check valve 82, which is now maintained open by the coupling 85, and through the check valve 89 into the vehicle tank inlet conduit 87. Referring to FIG. 5B, energizing the R6 relay 276 also closes contacts 320 on the line 317 extending between the flow transmitter 318 and the read-out head 321. This energizes and resets the read-out head 321 and closes the circuit to the transmitter 318, thus indicating flow through the sensor 69.

Referring to FIGS. 3 and 4, fluid passes through the vehicle tank inlet conduit 87 to discharge through the discharge elbow portion 206 adjacent the bottom of the liquid compartment 186. As best seen in FIG. 4, the liquid discharges from the elbow portion in direction of the arrow 207, which initially generates a generally circular flow within the tank centered on the axis 195. With sufficiently high discharge pressure, which is clearly possible with the present invention, when the tank is initially essentially empty, incoming fluid can flow completely circumferentially around the tank against the side wall 190 of the tank, thus generating a generally circulating flow within the liquid compartment of the tank. This circulating flow produces thorough mixing of the cold liquid from the conduit 87 with any relatively warm liquid and most of the vapour in the compartment 186, which rapidly reduces tank pressure and enhances pressure differential between the tank and delivery pump, thus maintaining high inlet flow velocities. This high volume circulating flow is possible at least while the tank is only partially full, and causes the vapour to condense quickly. Condensing the vapour and cooling the tank transfers heat to the incoming liquid, but the volume of incoming liquid is sufficiently high as to produce a negligible rise in temperature of the liquid. Thus, there is a negligible rise in tank pressure due to this heat transfer which eliminates the need for venting and permits maintenance of a high fluid discharge flow rate into the tank due to relatively low tank pressure.

In summary, the fluid is discharged into the tank generally tangentially to the main axis of the tank at a pressure sufficient to initially generate a generally circulating flow within the tank, at least while the tank is only partially full. The liquid is discharged rapidly into the tank so as to be sufficiently widely dispersed to increase chances of contact between the liquid and vapour in the tank so as to condense most vapour in the liquid tank and to cool the tank itself, so as to reduce tank pressure. Clearly, the discharge elbow portion 206 provides an inlet discharge-opening disposed to inject liquid into the tank to attain the sufficiently wide dispersal to increase contact between the liquid and any vapour. Alternative liquid discharge means can be devised without initially generating a circulating flow, and one example is described with reference to FIG. 7. In any event, incoming liquid is widely dispersed so that contact with vapour is increased, and the inlet conduit also serves as a means to drain the vehicle tank, and thus has at least an opening located at a lowermost position in the tank to effect efficient drainage.

As the liquid compartment 186 is being filled, volume of the vapour space 215 within the compartment 186 decreases and eventually the liquid surface 210 approaches the downwardly inclined inlet elbow portion 212 of the overflow inlet portion 211 which is located within the space 215. When the liquid level contacts the inlet elbow portion 212, the overflow conduit 209 is suddenly exposed to a volume of liquid forced into the elbow and at least partially into the conduit 209. Because the overflow conduit 209 has a considerably smaller cross-sectional area than the tank inlet conduit 87, there is a restriction of overflow liquid flow along the overflow conduit 209, which develops a sudden pressure differential between the liquid compartment 186 and the vapour compartment 188 due to restriction of flow from the tank. This sudden pressure rise is detected by the pressure sensor 162 cooperating with the differential conduit 223 and, if the rise exceeds a pre-determined upper pressure limit, contacts of the differential pressure switch 277 (FIG. 5A) are opened, thus de-energizing R5 relay 275 which in turn cuts power in the line 287 to de-energize the R6 relay 276 (FIG. 5B) and simultaneously unlatches the R6 relay contacts 290. The contacts 296 of the R6 relay thus open, cutting power to the fill solenoid 154 and the light 306 which immediately reverts the circuit into a recirculating or cool down mode, with the pump motor 105 still operating. The contacts 320 of the R6 relay are opened, interrupting the communication to the read-out head 321 (FIG. 5B) which then shows the amount of fluid dispensed by the apparatus.

As best seen in FIG. 4, the small volume of the vapour space 215 remaining above the liquid surface 210 and adjacent the upper portion of the compartment 186 when the pressure responsive switch is activated serves as a "cushion" to reduce shock of a sudden rise in the pressure differential. Clearly, momentum of fluid passing along the delivery conduit and delays in the circuitry do not result in instantaneous stopping of the inlet flow and thus the cushioning reduces "hydraulic hammer" problems that might otherwise arise.

It can be seen that the pressure lead 161, the first delivery conduit coupling lead 157 and associated circuitry serves as means coupling the pressure sensor to controls of the pump apparatus 11 supplying the liquid to the inlet conduits, so as to stop the pump when the predetermined upper limit of the pressure differential between the vapour and liquid tank is attained. The above operation is the usual way of detecting an essentially full tank, and eliminates the problems associated with prior art methods wherein the operator attempts to estimate from viewing vented vapour when a highly agitated liquid within the tank has reached a maximum volume.

Thus, it can be seen that one aspect of the invention relates to a pressure responsive method of stopping liquid flow into the tank by restricting flow of excess liquid overflowing from the liquid compartment to the vapour compartment when the liquid compartment is essentially full. This method requires simultaneously monitoring the pressure differential between the liquid delivery conduit 202 and the vapour delivery conduit 219 associated with the tank during delivery of the liquid into the tank. The supply of liquid to the liquid conduit is stopped in response to an increase in pressure differential which exceeds the pre-determined limit of the sensor 162 and opens the pressure switch contacts 277.

Restricting flow along the overflow conduit 209 will also cause a sudden rise of gauge pressure in the inlet conduit portion 200 which could approach design pressure of the tank 15. Thus, an alternative to detecting excess or predetermined differential pressure would be to detect a predetermined or excess gauge pressure in the inlet conduit with the alternative gauge pressure sensor 162.1. High inlet pressure which approaches tank design pressure opens the contacts of the differential pressure switch 277.1 which stops the pump by sequentially de-energizing the R5 relay 275 and the R6 relay 276 in a manner similar to that previously described. Thus, assuming that the gauge pressure sensor 162.1 is set to a threshold pressure essentially equal to design pressure of the tank 15, not only would the sensor 162.1 stop the delivery into the tank 15 if the gauge pressure rise reached the limit, it would also serve to protect the tank 15 against high internal pressure should the pump delivery pressure be much higher than the tank design pressure.

An alternative or "back-up" temperature responsive method of detecting when the tank is full is provided and can be operated before, simultaneously With, or after the pressure responsive method as above described. Thus, the temperature responsive method is redundant if the pressure responsive method is actuated first, but should there be a delay or a failure in the pressure responsive method, or if a person tries to restart the dispensing pump after cut-off due to the liquid compartment being full, the following temperature responsive method would be activated. When the overflow conduit 209 contains sufficient excess liquid from the compartment 186, a column of liquid runs from the upper portion of the conduit 209, down the vertical diametrically aligned portion and is discharged from the overflow-outlet 214 where it sprays onto the thermocouple or temperature sensor 164 located adjacent a lower end of the temperature sensor lead protector 224. Discharge of excess liquid from the outlet 214 produces a sudden drop in temperature in the thermocouple 164, which in turn opens contacts of the temperature switch 279 of FIGS. 5A and 5B, which de-energizes R6 relay 276 (FIG. 5B) and thus changes the mode from fuelling mode back to cool down or recirculating mode.

Thus, it can be seen that another aspect of the invention relates to a temperature responsive method of stopping the liquid flow into the vehicle tank by monitoring temperature of a space in the vapour compartment to detect any excess liquid discharged thereinto from the liquid compartment tank to indicate that the liquid compartment is full, and stopping supply of the liquid to the supply conduit when a monitored temperature of the vapour tank drops below a threshold temperature due to the discharged excess liquid. Clearly, for the temperature responsive method to be effective, the temperature sensor 164, i.e. the thermocouple junction must be at a temperature higher than the liquid.

The above description relates to the method of filling the vehicle tank 15, and automatically stopping the fill procedure when the tank is filled. Clearly, the filling process can be stopped manually by pushing the stop fill push button 253, which de-energizes the R3 relay 273, which in turn opens the contacts 283 in the line 287. This de-energizes R6 relay 276, which opens the contacts 296 to de-energize the fill solenoid 154. Thus, the main delivery valve 72 and the recirculating valve 67 of FIG. 1 are closed and opened respectively, to put the apparatus into the cool down mode.

The following description relates to feeding fuel from the tank 15 to the engine through the vehicle fuel pump 233 by removing both cryogenic vapour and liquid from the tank 15 in such a manner that the liquid only is removed when the pressure in the surge tank is low, and vapour starts to be removed when pressure in the surge tank 239 is sufficiently high for engine demand, and the vapour pressure in the vehicle tank is higher than the high set point. In contrast to prior art methods of supplying only liquid fuel under relatively high pressure to an engine, the fuel pump 233 can raise both cryogenic liquid and vapour out of the vehicle tank, and can compress the vapour to the required pressure for burning, thus eliminating fuel loss by venting vapour which would otherwise be necessary in prior art systems.

As previously stated, the vehicle fuel pump 233 of FIG. 3 operates essentially identically to the pump apparatus 11 of FIGS. 1 and 2, and receives cryogenic fluid upon demand, which is delivered intermittently from the liquid delivery conduit 202 through the valve 230, and the vapour delivery conduit 219 through the valve 231. In contrast with the pumping apparatus 11, which is started manually and normally stops automatically when the vehicle tank is full, starting and stopping of the fuel pump 233 is automatic and is responsive to pressure in the surge tank 239 and the vehicle tank 15, as measured by the surge tank pressure sensor 240 and the vapour pressure sensor 228. In FIG. 3, the sensors 240 and 228 generate signals which are fed to control unit 232, which in turn outputs signals to control the valves 230 and 231, and the pump motor 234 as follows. This results in the fuel pump motor being stopped and re-started in response to fuel demand, which in turn reflects power demand of the engine.

Figure 6:
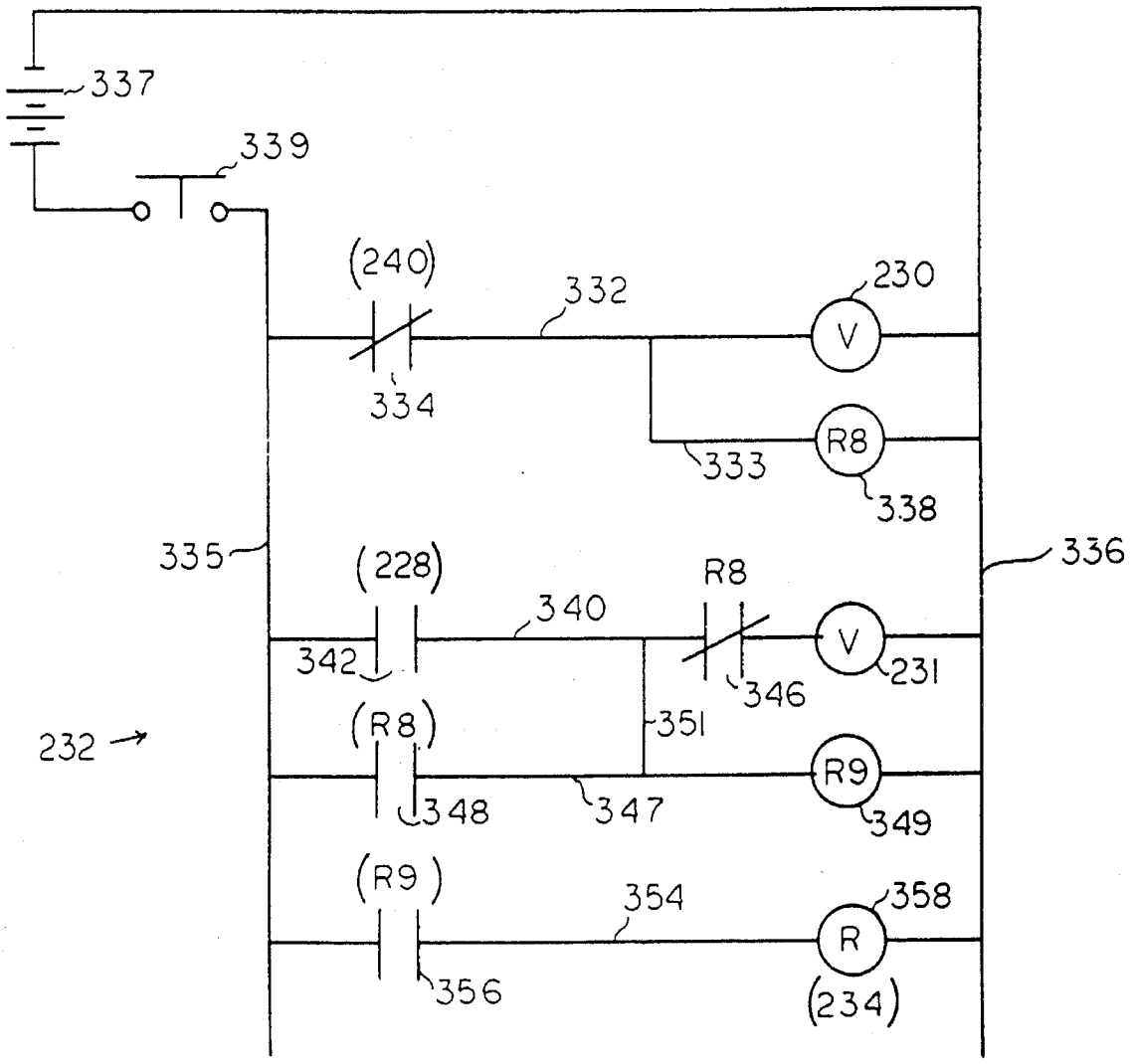
FIG. 6 is a simplified electrical diagram showing sensors and relays for valves associated with the vehicle fuel tank and the associated engine fuel pump according to the invention.

Referring mainly to FIG. 6, for the following example of a first state of the system, it is assumed that the tank 15 has recently been filled, and that the vehicle engine has not been operated for some time. Consequently, the pressure in the vapour delivery conduit 219 is relatively low, i.e. below the low set point of the vapour pressure sensor 228, and the pressure in the surge tank is relatively low, i.e. below the low set point of the surge tank pressure sensor 240. The connecting line 335 is energized by the electric battery 337 by closing the vehicle power-on switch 339. The contacts 334 of the surge tank pressure sensor are closed due to the relatively low pressure, thus energizing the connecting line 332, which opens the liquid control valve 230 and energizes the R8 relay 338. Consequently, the relay contacts 346 in the line 340 are opened, thus preventing electricity from energizing the vapour flow control valve 231. The contacts 342 of the vapour pressure sensor 228 are open, and the R8 relay contacts 348 are closed, thus supplying power to the line 347 to energize R9 relay 349. The R9 relay contacts 356 in the line 354 are thus closed, and power is supplied to the vehicle pump motor relay 358 which thus energizes the motor 234. Thus, the fuel pump 233 starts to reciprocate, and pumps liquid into the surge tank which increases pressure in the surge tank. Depending on demand for fuel from the surge tank to the engine, pressure in the surge tank will tend to rise, and eventually reach the high set point which opens the contacts 334 of the sensor 240. This opening cuts power in the line 332, which de-energizes and closes the liquid control valve 230 and also de-energizes the R8 relay 338 which closes the contacts 346 in the line 340, and opens the switch 348 in the line 347. Because vapour pressure is low, the contacts 342 of the sensor 228 remain open, and because the R8 relay contacts 348 are open, power to the line 347 is cut which de-energizes the R9 relay 349. This causes the R9 relay contact 356 in the line 354 to open, thus cutting power to the vehicle pump motor relay 358 which then stops.

In a second state, it is assumed that the vehicle has been operating for a long time with low demand on the engine. Thus, the vapour pressure in the tank 15 is high and the contacts 342 of the sensor 228 are closed. Also, pressure in the surge tank is high and thus the contacts 334 of the sensor 240 are open. As the contacts 334 are open, power is cut to the line 332, so as to de-energize the R8 relay 338 and to close the liquid control valve 230. The R8 relay contacts 346 in the line 340 are thus closed, and because the pressure sensor contacts 342 are also closed, the line 340 feeds power to the vapour control valve 231 which opens to feed vapour to the pump and to relieve pressure in the vehicle tank. The line 347 receives power through the now closed contacts 342 in the line 340 and the inter-connecting line 352, which energizes the R9 relay 349, which in turn closes the R9 contacts 356 in the line 354, thus providing power to the vehicle pump motor relay 358, so that the fuel pump can operate to supply vapour from the vehicle tank 15. If the surge tank pressure is reduced by the engine demand, as the surge tank pressure drops below the low set point, the surge tank pressure sensor contacts 334 are closed, thus supplying power to the line 332 which powers the liquid control valve 230 open and energizes the R8 relay 338 as before. Thus, the R8 relay contacts 346 will open, the vapour control valve 231 will then close, and the engine demand is satisfied by liquid supplied through the valve 230 regardless of the pressure in the vehicle tank.

In a third state, if pressure in the vapour delivery conduit 219 is low and pressure in the surge chamber is high, the pump cannot operate. This is because the contacts 334 of the surge tank pressure sensor 240 are open and thus the power to the R8 relay 338 and the liquid delivery valve 230 is cut. This closes the liquid control valve 230 and opens the R8 relay contacts 348. Also, the contacts 342 of the vapour pressure sensor switch 228 are open, and thus the valve 231 is closed. The R9 349 relay is de-energized which in turn opens the contacts 356 in the line 354 to cut power to the vehicle pump motor 234. When pressure in the surge tank is reduced below the low set point, the pump motor can be restarted to pump liquid.

From the above, it can be seen that the pump 233 receives vapour from the conduit 219 only when surge tank pressure has been high and has not yet dropped to the low set point, and the vapour pressure in the vehicle tank has closed the switch 342 and not yet attained the lower set point. When these double conditions are satisfied, the valve 231 opens and the vapour passes through the fuel pump 233 to increase pressure in the surge chamber, which pressure is rapidly reduced when the engine is demanding power. Any fuel from the engine which reduces surge tank pressure below the low set point results in the liquid control valve 230 opening, with concurrent closing of the vapour valve 231, so as to supply cryogenic liquid to the pump, which provides greater flow of fuel to meet the fuel demand from the engine. In contrast, when the engine is at idle, the fuel pump 233 is supplied with vapour from the conduit 219 as long as the vapour pressure sensor 228 has been closed due to high pressure in the engine fuel tank, and the surge tank pressure has not yet reached the low set point. Clearly, with low fuel demand after the vehicle has been unused for a long time, the fuel pump can be inoperative for a relatively long time while the vapour pressure is reduced, and is restarted to meet a higher fuel demand from the engine.

Thus, it can be seen that the fuel pump of the invention can not only feed cryogenic vapour and liquid to the engine, but it can be used to prevent excessive pressure build-up in the vapour chamber of the vehicle tank, by pumping excess vapour into the surge tank 239 for use by the engine when required. Because vapour alone cannot meet full fuel demand from the engine, whenever the engine demands full fuel requirements, the surge tank pressure rapidly drops below the low set point causing the liquid control valve 230 to open to supply cryogenic liquid to the pump which immediately satisfies the engine demand. Most vehicles do not require full fuel demand for all operating conditions, e.g. when the engine is at idle when the vehicle is stopped, or when the vehicle is descending, with the engine essentially coasting. At these times, any excess pressure of vapour in the fuel tank can be delivered to the surge tank, so as to reduce vehicle tank pressure and to permit the vapour to be consumed by the engine when the engine demands it. However, because engine demands can rapidly change from idle to full power, engine fuel demand is not compromised by undue use of vapour, but instead liquid is supplied essentially instantly when surge tank pressure drops below the low set point. This enables a vehicle to operate for a long period without venting of vapour, as the vapour is automatically removed by burning in the vehicle engine.

Thus, it can be seen that a method of supplying cryogenic fluid fuel to an engine comprises the steps of:

conducting cryogenic vapour from a tank in a vapour conduit;

conducting cryogenic liquid from the tank in a liquid conduit; and selectively receiving cryogenic liquid and vapour from the respective conduits at an inlet of a pump and pumping cryogenic liquid to satisfy fuel demand, and when the fuel demand is satisfied, pumping cryogenic vapour to reduce vapour pressure in the tank.

This is attained by temporarily storing the cryogenic fluid prior to supplying the fluid to the engine to permit the pump to be stopped, while monitoring pressure of the stored cryogenic fluid to detect when the pump should be restarted. Simultaneously, pressure of the cryogenic vapour in the fuel tank is monitored so as to transfer vapour from the fuel tank into storage when there is sufficiently high vapour pressure in the fuel tank. The fuel pump is stopped when no longer required, thus reducing wear etc.

It can be seen that the delivery valves associated with the vapour delivery conduit and the liquid delivery conduit and associated controls and sensors selectively supply cryogenic fluid to the pump in response to engine demand. The invention has a liquid supply means, namely the liquid control valve 230, for supplying cryogenic liquid to the engine to satisfy a relatively heavy demand from the engine, and a vapour supply means, namely the vapour control valve 231, for supplying vapour to the engine when the heavy demand is satisfied. The vapour supply means uses excess vapour from the tank to reduce vapour pressure in the tank, and thus permit extended use of the vehicle, without requiring venting as is common in the prior art. It can be seen that the surge tank 239 serves as a storage means for temporarily storing pressurized cryogenic fluid prior to supplying the fluid to the engine, the storage means communicating with the fuel pump to receive pressurized fluid therefrom. Clearly, the surge tank pressure sensor serves as a pressure sensing means for monitoring pressure of the temporarily stored cryogenic fluid in the surge tank. The fluid output control unit 232 serves as a control means communicating the pressure sensor with the fuel pump so that operation of the pump is responsive at least to pressure of the stored cryogenic fluid. In addition, the vapour pressure sensor 228 serves as the pressure sensing means for monitoring pressure in the vehicle tank and the control unit 232 similarly communicates the pressure sensor of the vehicle tank with the fuel pump so that when vapour pressure in the vehicle tank is sufficiently high, the vapour is transferred by the fuel pump to the storage means so as reduce pressure in the vehicle tank. This simple structure reduces many problems, e.g. eliminating the need for separate venting of vapour, reducing chances of tank rupture and also enabling full recovery of energy in the cryogenic fluid.

ALTERNATIVES

FIG. 7

The single dual purpose inlet/outlet conduit 87 of FIGS. 3 and 4 has a discharge elbow portion 206 adapted to discharge incoming liquid in a generally circular motion around the side wall of the tank, and is adapted to draw fluid through the elbow when emptying or draining the tank. As discussed previously, if there is a rupture of the conduit 202, or an equivalent single conduit for a prior art tank, vapour pressure within the tank would rapidly displace fluid within the tank through the conduit 87 and the rupture, until tank vapour pressure equalized with atmospheric pressure. This is hazardous, and some authorities would require regulation to prevent catastrophic discharge of liquid in such an event.

Figure 7:
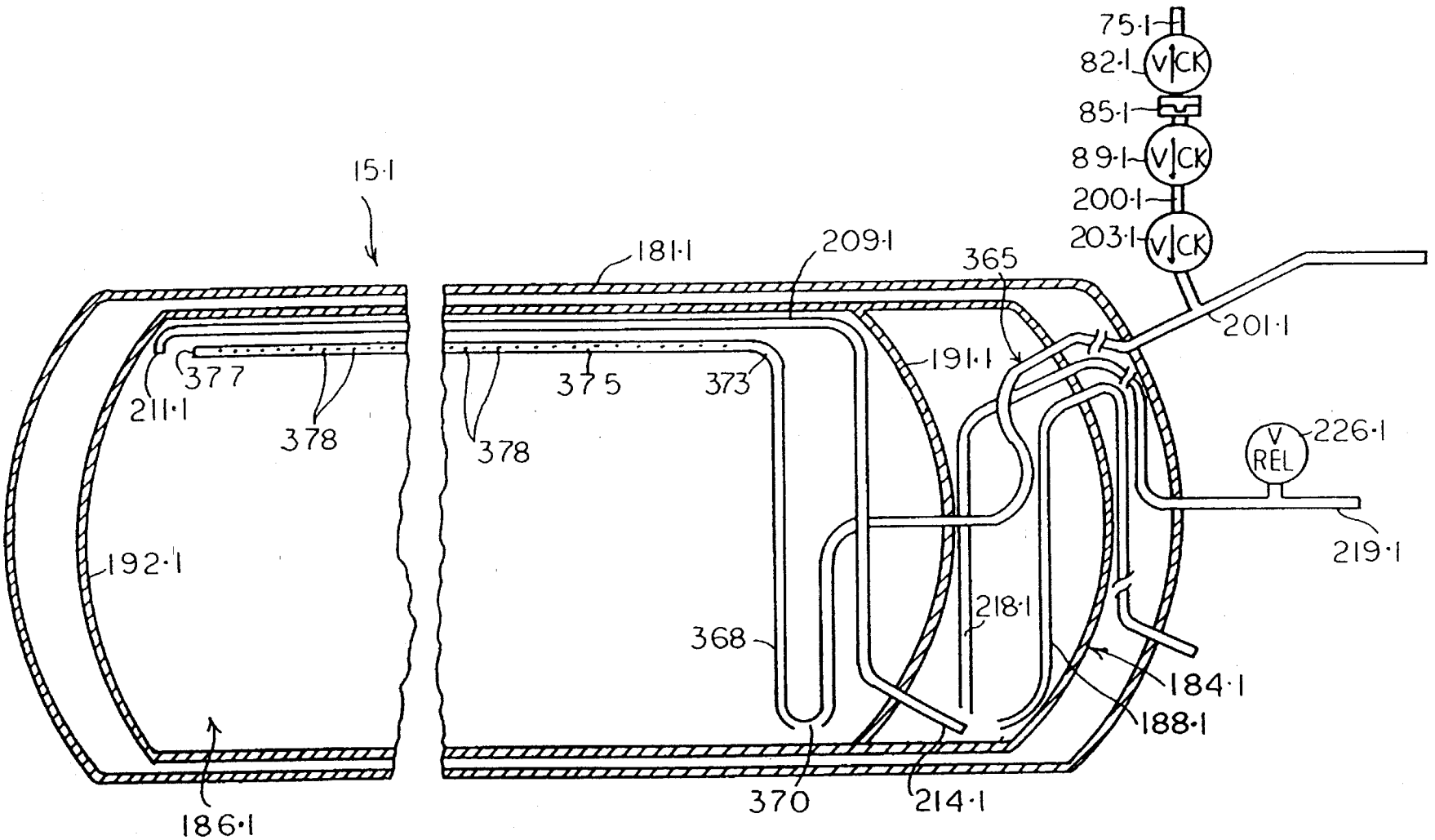
FIG. 7 is a simplified, fragmented longitudinal section through vehicle tank generally similar to that as shown in FIG. 3, showing an alternative means of discharging incoming liquid into the tank, and drawing liquid from the tank.

An alternative dual purpose inlet/outlet conduit 365 considerably reduces these hazards, and is shown in FIG. 7 cooperating with a tank 15.1 which is essentially identical in all other aspects to the tank 15 as previously described in FIGS. 3 and 4. Consequently, components of the tank 15.1 of FIG. 7 which are identical with the equivalent components of the embodiment of FIGS. 3 and 4 are designated in FIG. 7 with the same numerical references, followed by .1. Thus, FIG. 7 shows the tank 15.1 fitted with the overflow conduit 209.1 and a vapour collecting conduit 218.1. The alternative inlet/outlet conduit 365 extends inwardly from the junction 201.1 and sealably penetrates the tanks 181.1 and 184.1 and the bulkhead 191.1 in a manner generally similar to the conduit 87. The conduit 365 has a generally vertically disposed U-shaped portion 368 which is adjacent the bulkhead 191.1 and has a drain opening 370 adjacent a lower portion thereof. The opening 370 can be on any surface of the lower portion of the U-shaped portion 368. If the opening 370 is on an upper surface, incoming liquid might be sprayed upwardly therefrom, increasing contact with vapour in the compartment. If the opening is on a lower surface, it would be spaced closely adjacent a lower wall of the liquid compartment 186.1. The U-shaped portion extends upwardly to a 90° elbow 373 and extends to a generally horizontal perforated portion 375. The horizontal portion 375 extends throughout most of the length of the liquid compartment 186.1 adjacent an uppermost portion of the liquid compartment 186.1 to a closed outer end 377. The portion 375 has a plurality of spray openings 378 disposed on opposite sides thereof, which openings are adapted to discharge incoming liquid generally outwardly from the pipe so as to disperse liquid in a wide array throughout the liquid compartment, so as to increase contact between the spray and any vapour within the chamber to condense the vapour.

The drain opening 370 is of a size sufficient to accept maximum flow of fuel demanded by the engine with a minimal pressure differential across the opening, and is adapted to drain most of the liquid from the tank. At least a portion of the conduit 365 between the opening 370 to the end 377 has a cross-sectional area considerably greater than the drain opening area e.g. about 5 times, but it could be between 3 and 10 times greater. The spray openings 378 in the horizontal perforated portion 375 do not greatly affect normal draining of the tank which occurs through the opening 370 in a manner similar to the elbow portion 206 of FIGS. 3 and 4. Preferably, sum of cross-sectional areas of all the spray openings 370 is about 2 or 3 times greater than the cross-sectional area of the conduit 365. Therefore, total cross-sectional area of spray openings 378 is considerably greater than cross-sectional area of the drain opening 370 e.g. total area of the spray openings 378 is about 6 to 30 times greater than the area of the drain opening 370. Thus, the total area of spray openings is greater than the cross-sectional area of the conduit 365, which is greater than cross-sectional area of the drain opening 370. When the tank is being filled, while some liquid may pass outwardly through the drain opening 370, most of the incoming liquid passes through the spray openings 378 to condense vapour within the liquid compartment 186.1.

The alternative conduit 365 has a particular advantage if the conduit 201.1 disposed outwardly of the tank 181.1 is ruptured in an accident. Usually, there is a relatively large pressure differential, e.g. 30 PSI (308 kPa), between the liquid compartment 186.1 and atmospheric pressure, which is rapidly exhausted by the vapour in the compartment 186.1 passing through the spray openings 378, and through the U-shaped portion 368 and out through the rupture. Any liquid remaining in the U-shaped portion 368 is initially discharged through the rupture, but this is of relatively limited volume and hence considerably less of a hazard than the hazard that would occur with rupturing a conduit associated with a tank of the prior art. Some liquid within the tank may pass through the opening due to suction of the vapour leaving the tank, but this is relatively small compared with overall volume of liquid in the tank.

Thus, in summary, it can be seen that an alternative inlet discharge opening means has a plurality of spray openings to discharge a spray of liquid into the tank, thus condensing vapour within the tank. Also, the inlet conduit has a drain opening adjacent a lower wall of the tank to drain liquid from the tank, the drain opening having an opening area considerably less than sum of areas of the spray openings, and also less than cross-sectional area of the conduit.

FIG. 3 shows the vehicle tank supplying cryogenic vapour and liquid to the fuel pump 233 for use in an engine fuel system which requires fuel delivery at a pressure greater than pressure within the tank 15, which is termed relatively high pressure and contrasts with relatively low fuel pressures required for some natural gas engines. Thus, if the fuel tank 15 of the present invention is required to supply fuel to an engine which operates on a fuel pressure which is lower than the minimum operating pressure of the tank, no fuel pump is required. In this instance, the pump 233 and associated surge tank 239 would be eliminated, and instead the cryogenic fluid from the junction 220 would be supplied to a conventional vaporizer, not shown, and then directly into the carburettor or other air/fuel metering induction system of the engine. Consequently, the control unit 232 would be considerably simplified, as it would now control opening of the liquid control valve 230 and the vapour control valve 231 in a manner similar to prior art low pressure fuel systems. In this alternative, the valves 230 and 231 will always be in opposite phase when vehicle power is turned on, and both will shift in response to a signal from the pressure switch 228, which of course is exposed to vapour pressure in the tank. If the tank pressure is relatively high, e.g. 60 PSIG (515 kPa), the switch 228 is energized and opens valve 231 and closes valve 230. The engine would then be fuelled by vapour, causing pressure in the tank 15 to drop. When pressure in the tank 15 reaches a low set point, e.g. 40 PSIG (377 kPa), the switch 229 will close the valve 230 and open the valve 231, and the engine will then be fuelled by liquid fuel. It can be seen that there are alternative uses of the fuel tank for low pressure fuel systems which do not require a vehicle fuel pump resembles some prior art systems.

In summary, in this alternative, the engine fuel system is supplied with either vapour or liquid, depending only on vehicle tank pressure, which, as before, would be used in the engine. When a high set point is exceeded, the fuel system supplies vapour so as to permit maintenance of vapour pressure below a high pressure which would otherwise require venting. Thus, the benefits of the vehicle tank 15 can be attained for either high fuel pressure natural gas engines or low fuel pressure natural gas engines, one major difference being that the high pressure natural gas engines would require the fuel pump 233 as previously described.

In summary, some of the major advantages of the present pumping apparatus include the ability of the pump to pump efficiently cryogenic vapour and liquid, and to be able to operate at a negative feed pressure. These advantages permit the pump to be used in at least two widely different applications, namely as a dispensing pump at a dispensing station, and as an engine fuel delivery pump, e.g. for use in a vehicle. In both of these applications, the pump can be located outside the cryogenic liquid container or tank, thus simplifying installation, operation and maintenance of the pump. The effectiveness of the pump is attributed to a unique fluid inducting means which comprises at least four specific aspects as follows:

(i) The pump piston is displaced at an essentially constant velocity throughout length of the induction stroke, so as to generate essentially steady state induction flow conditions for most of the induction stroke.

(ii) The inlet port has a size, when opened, which is essentially equal to size of the inlet conduit so as to produce negligible restriction of flow of fluid into the cylinder.

(iii) The stroke displacement volume of the pump for a single piston stroke thereof is at least two orders of magnitude greater than residual volume remaining in the cylinder when the piston is in a dead position, which is attained during a stroke changeover.

(iv) The inlet conduit means leading from the fluid source to the inlet port has a total volume which is generally smaller than stroke displacement so that ratio of volume of the inlet conduit means to the stroke displacement is within the range of between 1:10 and 1:1.

The four aspects of the fluid inducting means described briefly above are considered to contribute to the effectiveness of the present invention, although the relative importance of each of the four aspects is not known at this time.

In addition, the vehicle fuel tank has advantages which increase safety and effectiveness, and relate to the inner tank having a bulkhead to physically separate the liquid and vapour compartments, so as to positively define the ullage space. The overflow conduit extending between the two compartments provides communication therebetween to indicate accurately when the liquid compartment is filled, and to automatically stop filling the tank in response to changes in pressure and/or temperature. The physical separation of the liquid and vapour compartments reduces many of the problems associated with prior art tanks in which the ullage space is inaccurately controlled and relies upon skill of the operator when filling the tank.

I claim:

1. A cryogenic liquid storage tank system for the storage of a cryogenic fluid, which system comprises:

a) a cryogenic storage tank having:

i) a liquid compartment to store cryogenic liquid;

ii) a separate vapor compartment as ullage space for a cryogenic vapor; and iii) a tank inlet conduit into the liquid compartment and having a discharge opening in the liquid compartment for the introduction of a cryogenic fluid into the liquid compartment;

b) an overflow conduit means having an inlet disposed in an upper portion of the liquid compartment and an outlet disposed within the vapor compartment to provide for the flow of excess cryogenic fluid from the liquid to the vapor compartment when the liquid compartment is full to the level of the inlet of the overflow conduit means, and wherein the overflow conduit means has a cross-sectional area less than the cross-sectional area of the tank inlet conduit to restrict flow of excess cryogenic liquid from the liquid compartment and to promote a sudden pressure rise and differential pressure increase when the liquid compartment is full;

c) a liquid transfer means to transfer a cryogenic fluid through the tank inlet conduit and into the liquid compartment;

d) control means to control the operation of the liquid transfer means; and e) pressure sensor means to sense a sudden pressure rise above a predetermined level when the liquid compartment is full, the pressure means to monitor the pressure in the liquid compartment or the differential pressure between the liquid and vapor compartments, and the sensor means to provide a pressure sensing signal, the pressure sensing signal coupled to the control means and arranged to stop the liquid transfer means from filling the liquid compartment, thereby providing for the automatic monitoring of the filling of the liquid compartment of the storage tank to the level of the inlet of the overflow conduit means.

2. The system of claim 1 wherein the vapor compartment has a volume which is between about 10 and 15 percent of the volume of the liquid compartment to provide a defined ullage space.

3. The system of claim 1 wherein the liquid transfer means comprises a hydraulic or electric motor driven reciprocating piston pump which operates at a net negative suction head.

4. The system of claim 1 wherein the tank inlet conduit comprises a single integral inlet and outlet conduit into the liquid compartment.

5. The system of claim 1 wherein the discharge opening of the inlet conduit has an outlet portion which is disposed generally tangentially with respect to the cross-section of the liquid compartment to generate initially a generally circulating flow within the liquid compartment.

6. The system of claim 1, wherein:

a) the discharge opening of the tank inlet conduit comprises a plurality of spray openings in the upper portion of the liquid compartment to discharge a spray of cryogenic liquid into the liquid compartment; and b) the tank inlet conduit has a drain opening adjacent a lower wall of the liquid compartment to drain cryogenic liquid from the liquid compartment through the discharge opening, the drain opening having an opening area less than the sum of opening areas of the spray openings and less than the cross-sectional area of the tank inlet conduit.

7. The system of claim 6, wherein:

a) the spray openings of the tank inlet conduit are located adjacent an upper portion of the liquid compartment of the storage tank; and b) the tank inlet conduit has a U-shaped portion located in the liquid compartment, the liquid spray opening being located in the U-shaped portion.

8. The system of claim 1 wherein the inlet of the overflow conduit means includes a downwardly facing elbow portion which is positioned adjacent a side wall on the upper portion of the liquid compartment.

9. The system of claim 1 wherein the ratio of the cross-sectional areas of the overflow conduit means to the tank inlet conduit is between 1:2 and 1:4.

10. The system of claim 1 wherein the pressure sensor means provides a differential pressure sensing signal above 10 psi.

11. The system of claim 1 wherein the pressure sensing signal is produced at a predetermined upper pressure less than the designed upper pressure limit of the cryogenic storage tank.

12. The system of claim 1 wherein the pressure sensor means includes both a gauge pressure sensor means to measure the pressure of the cryogenic liquid in the liquid compartment and a differential pressure sensor means to measure the differential pressure between the vapor and liquid compartments, and wherein a pressure sensing signal from either pressure sensor means to the control means stops the liquid transfer means.

13. The system of claim 1 wherein the overflow conduit means is free of any valves.

14. The system of claim 1 wherein the overflow conduit means has the outlet in the lower portion of the vapor compartment.

15. The system of claim 1 wherein the cryogenic storage tank is a LNG storage tank with the liquid compartment to store LNG and the vapor compartment for LNG vapor.

16. A liquid natural gas (LNG) storage tank system for the storage of LNG, which system comprises:

a) an LNG storage tank having:

i) a liquid compartment to store LNG;

ii) a separate compartment as ullage space for vaporized natural gas (VNG);

iii) a single tank inlet/outlet conduit into the liquid compartment having a discharge opening in the upper portion of the liquid compartment;

b) an overflow conduit means having an inlet into the liquid compartment and an outlet disposed in the vapor compartment to provide for the flow of excess LNG during filling of the liquid compartment into the vapor compartment;

c) the cross-sectional area of the overflow conduit means is less than the cross-sectional area of the tank inlet/outlet conduit to permit a sudden pressure increase when the liquid compartment is full to the level of the inlet of the overflow conduit means;

d) LNG liquid transfer means to transfer LNG through the tank inlet/outlet conduit into the liquid compartment;

e) control means to control the operation of the liquid transfer means;

f) pressure sensor means which comprises a gauge pressure sensor means to sense the pressure in the liquid compartment and to provide a first pressure sensing signal when the LNG reaches the level of the inlet of the overflow conduit means, or a differential pressure sensor means to sense the differential pressure between the liquid compartment and the ullage space and to provide a second pressure differential sensing signal if there is a differential pressure rise of above about 10 psi, either first or second pressure sensing signals or both connected to the control means so arranged to stop the liquid transfer means in filling LNG into the liquid compartment.

17. In combination, an LNG operated vehicle with an LNG engine and which vehicle contains the system of claim 16 and wherein the LNG storage tank includes a vapor collecting conduit between the vapor compartment and the LNG engine.

* * * * *